US012084255B2

(12) United States Patent
Fu et al.

(10) Patent No.: US 12,084,255 B2
(45) Date of Patent: Sep. 10, 2024

(54) PACKAGING STRUCTURES

(71) Applicant: ZHEJIANG DAHUA TECHNOLOGY CO., LTD., Zhejiang (CN)

(72) Inventors: Qiujia Fu, Hangzhou (CN); Yikun Liang, Hangzhou (CN); Quan Gan, Hangzhou (CN)

(73) Assignee: ZHEJIANG DAHUA TECHNOLOGY CO., LTD., Hangzhou (CN)

( * ) Notice: Subject to any disclaimer, the term of this patent is extended or adjusted under 35 U.S.C. 154(b) by 96 days.

(21) Appl. No.: 17/454,825

(22) Filed: Nov. 15, 2021

(65) Prior Publication Data

US 2022/0073252 A1 Mar. 10, 2022

Related U.S. Application Data

(63) Continuation of application No. PCT/CN2020/094762, filed on Jun. 5, 2020.

(30) Foreign Application Priority Data

Jun. 5, 2019 (CN) ..... 201920849592.2
Oct. 15, 2019 (CN) ..... 201921729841.0

(51) Int. Cl.
*B65D 81/07* (2006.01)
*B65D 5/20* (2006.01)
(Continued)

(52) U.S. Cl.
CPC ..... *B65D 81/07* (2013.01); *B65D 5/2057* (2013.01); *B65D 5/305* (2013.01); *B65D 5/5088* (2013.01); *B65D 5/60* (2013.01); *B65D 2581/055* (2013.01)

(58) Field of Classification Search
CPC .... B65D 5/5028; B65D 81/07; B65D 81/075; B65D 5/5035; B65D 81/05; B65D 5/305
(Continued)

(56) References Cited

U.S. PATENT DOCUMENTS 5,413,412 A * 5/1995 Odabashian ..... B29C 59/10 493/930
5,676,245 A * 10/1997 Jones ..... B65D 5/5028 206/466
(Continued)

FOREIGN PATENT DOCUMENTS

CN 2637358 Y 9/2004
CN 205615864 U 10/2016
(Continued)

OTHER PUBLICATIONS

The Extended European Search Report in European Application No. 20818654.4 mailed on May 16, 2022, 10 pages.
(Continued)

*Primary Examiner* — Steven A. Reynolds
*Assistant Examiner* — Prince Pal
(74) *Attorney, Agent, or Firm* — METIS IP LLC

(57) ABSTRACT

The present disclosure provides a packaging structure. The packaging structure may include a sheet and a film. The sheet may include a base plate and a first side plate, a second side plate, a third side plate, and a fourth side plate. The film may at least include a first fixed part and a second fixed part. The first fixed part and the second fixed part may be fixedly connected with at least two side plates of the first side plate, the second side plate, the third side plate, and the fourth side plate, respectively. The packaging structure may achieve the purpose of stretching the film through the folding of the plurality of side plates, so that the film and the bottom plate
(Continued)

may form a packaging space to effectively package and fix an object, thereby improving the reliability of transportation.

20 Claims, 31 Drawing Sheets

(51) Int. Cl.
*B65D 5/30* (2006.01)
*B65D 5/50* (2006.01)
*B65D 5/60* (2006.01)

(58) Field of Classification Search
USPC ..... 206/521, 583, 497, 522
See application file for complete search history.

(56) References Cited

U.S. PATENT DOCUMENTS 5,678,695 A * 10/1997 Ridgeway ..... B65D 5/5028 206/583
5,894,932 A * 4/1999 Harding ..... B65D 81/075 206/583
6,047,831 A * 4/2000 Jones ..... B65D 81/02 206/466
6,073,761 A * 6/2000 Jones ..... B65D 5/5028 206/583
6,289,655 B1 * 9/2001 Ridgeway ..... B65D 81/075 206/583
6,308,828 B1 * 10/2001 Jones ..... B65D 77/003 206/583
6,675,973 B1 * 1/2004 McDonald ..... B65D 5/5028 206/583
6,942,101 B2 * 9/2005 Lofgren ..... B65D 81/075 206/583
8,028,838 B2 * 10/2011 McDonald ..... B65D 5/5028 206/583
8,727,123 B1 * 5/2014 Roberts ..... B65D 81/075 206/583
10,035,638 B1 * 7/2018 LeRoy ..... B65D 5/6652
2004/0129601 A1 * 7/2004 Lofgren ..... B65D 81/05 206/583
2004/0140243 A1 * 7/2004 Roesel ..... B65D 81/07 206/583
2004/0188309 A1 * 9/2004 Kudou ..... B65D 81/07 206/521
2005/0252825 A1 * 11/2005 Lofgren ..... B65D 5/5035 206/583
2006/0213803 A1 * 9/2006 Saitou ..... B65D 81/05 206/583
2010/0000907 A1 * 1/2010 Kashiwabara ..... B65D 5/5028 206/592
2011/0024324 A1 * 2/2011 Tanner ..... B65D 81/075 206/588
2011/0108450 A1 * 5/2011 Goodrich ..... B65B 23/00 206/521
2011/0240515 A1 * 10/2011 Ridgeway ..... B65D 5/5028 53/472
2013/0233752 A1 * 9/2013 Hammerschmidt . B65D 5/5028 53/467
2014/0183097 A1 * 7/2014 LeRoy ..... B65D 81/05 206/583
2017/0247163 A1 * 8/2017 Ridgeway ..... B65D 5/5028
2020/0031515 A1 * 1/2020 Zhang ..... B65D 5/5088
2021/0024267 A1 * 1/2021 Liu ..... B65D 61/00
2022/0204240 A1 * 6/2022 Fu ..... B65D 81/05

FOREIGN PATENT DOCUMENTS

CN 206297843 U 7/2017
CN 107934204 A 4/2018
CN 207482389 U 6/2018
CN 108263708 A 7/2018
CN 208307444 U 1/2019
CN 210618773 U 5/2020
CN 211055791 U 7/2020
WO WO-2014032059 A1 * 2/2014 ..... B65D 5/5016

OTHER PUBLICATIONS

International Search Report in PCT/CN2020/094762 mailed on Aug. 31, 2020, 5 pages.
Written Opinion in PCT/CN2020/094762 mailed on Aug. 31, 2020, 5 pages.

* cited by examiner

PACKAGING STRUCTURES

CROSS-REFERENCE TO RELATED APPLICATIONS

This application is a Continuation of International Application No. PCT/CN2020/094762 filed on Jun. 5, 2020, which claims priority of Chinese Patent Application No. 201920849592.2, filed on Jun. 5, 2019, and Chinese Patent Application No. 201921729841.0, filed on Oct. 15, 2019, the contents of which are hereby incorporated by reference.

TECHNICAL FIELD

One or more embodiments of the disclosure relate to packaging technology, in particular to a packaging structure.

BACKGROUND

During transportation, a certain object or product needs to be packaged to achieve a better transportation effect. When designing the packaging structure to fix the object, it is particularly important for the packaging structure to provide cushioning protection and guarantee the reliability of the packaging fixation for the object. Therefore, it is necessary to provide a packaging structure with better cushioning protection performance and/or reliability, thereby improving the reliability of transportation.

SUMMARY

One or more embodiments of the present disclosure provide a packaging structure. The packaging structure may include a sheet and a film. The sheet may include a base plate and a first side plate, a second side plate, a third side plate, and a fourth side plate. The first side plate, the second side plate, the third side plate, and the fourth side plate may be distributed around the base plate. The film may at least include a first fixed part and a second fixed part. The first fixed part and the second fixed part may be fixedly connected with at least two side plates of the first side plate, the second side plate, the third side plate, and the fourth side plate, respectively. The first side plate may be disposed opposite to the third side plate, and the second side plate may be disposed opposite to the fourth side plate.

In some embodiments, the first fixed part and the second fixed part of the film may be fixedly connected with the first side plate and the third side plate respectively.

In some embodiments, the film may fasten an object when being stretched by folding the first side plate and the third side plate towards a back of the base plate.

In some embodiments, a plurality of cutting lines may be disposed on the film to form a plurality of stretching holes.

In some embodiments, the plurality of cutting lines may include an arc line or a straight line.

In some embodiments, the plurality of cutting lines may include a semi-arc shape, an angular shape, or two semi-arcs connected via a straight line.

In some embodiments, the plurality of cutting lines may be evenly distributed in a region of the film.

In some embodiments, the base plate may include a first sub-base plate and a second sub-base plate. A folding line may be disposed between the first sub-base plate and the second sub-base plate. The second side plate may include two second sub-side plates disposed on either side of the folding line. The fourth side plate may include two fourth sub-side plates disposed on either side of the folding line.

In some embodiments, the packaging structure may further include a box body plate. The box body plate may include a box base plate, a first folding plate, a second folding plate, a third folding plate, and a fourth folding plate. The first folding plate, the second folding plate, the third folding plate, and the fourth folding plate may be distributed around the box base plate. The first folding plate may be disposed opposite to the third folding plate, and the second folding plate may be disposed opposite to the fourth folding plate. The fourth folding plate may be connected with the sheet at a side facing away from the box base plate.

In some embodiments, the fourth folding plate may be connected with the fourth side plate at the side facing away from the base plate.

In some embodiments, the second folding plate may be connected with a cover plate at a side facing away from the box base plate. The cover plate may be disposed opposite to the box base plate in a folding state of the packaging structure.

In some embodiments, the film may fasten an object at a packaging area of the packaging structure. An area of the film may be smaller than that of the packaging area.

In some embodiments, the film may have a plurality of sub-films, each of which includes a fixed part and a packaging part. The fixed part of each sub-film may be connected with at least part of the at least two side plates. The packaging part of each sub-film may cover at least part of the object to fasten the object in the packaging structure.

In some embodiments, the at least part of the object may include at least one of an angle part, an edge part, and a central part of the object.

In some embodiments, the fixed part of each sub-film may be fixedly connected with two adjacent side plates of the first side plate, the second side plate, the third side plate, and the fourth side plate, respectively. The packaging part of each sub-film may correspond to an angle part of the base plate.

In some embodiments, a count of the sub-films may be between the range of 2 to 4. The fixed part of each sub-film may be disposed outside of the base plate.

In some embodiments, the fixed part of each sub-film may be fixedly connected with two opposite side plates of the first side plate, the second side plate, the third side plate, and the fourth side plate, respectively.

In some embodiments, a count of the sub-films may be between the range of 1 to 3. The fixed part of each sub-film may be disposed outside of the base plate.

In some embodiments, the base plate may include a first supporting plate and a second supporting plate separated from each other. The first supporting plate may be connected with a margin of the base plate by a first folding line. The second supporting plate may be connected with a margin of the base plate by a second folding line. The first folding line may be disposed opposite to the second folding line.

Additional features will be set forth in part in the description which follows, and in part will become apparent to those skilled in the art upon examination of the following and the accompanying drawings or may be learned by production or operation of the examples. The features of the present disclosure may be realized and attained by practice or use of various aspects of the methodologies, instrumentalities, and combinations set forth in the detailed examples discussed below.

BRIEF DESCRIPTION OF THE DRAWINGS

The present disclosure is further described in terms of exemplary embodiments. These exemplary embodiments are described in detail with reference to the drawings. The drawings are not scaled. These embodiments are non-limiting exemplary embodiments, in which like reference numerals represent similar structures throughout the several views of the drawings, and wherein.

DETAILED DESCRIPTION

Figure 1:
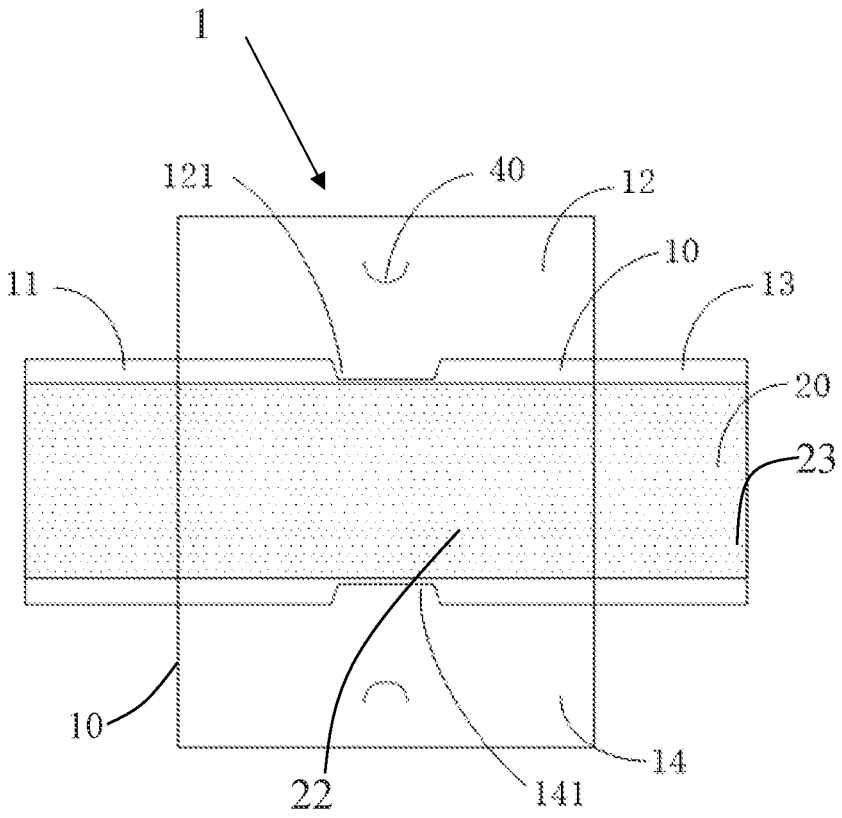
FIG. 1 is an expanded structural schematic diagram illustrating a protective liner of film packaging according to some embodiments of the present disclosure.

The following description is presented to enable any person skilled in the art to make and use the present disclosure and is provided in the context of a particular application and its requirements. Various modifications to the disclosed embodiments will be readily apparent to those skilled in the art, and the general principles defined herein may be applied to other embodiments and applications without departing from the spirit and scope of the present disclosure. Thus, the present disclosure is not limited to the embodiments shown but is to be accorded the widest scope consistent with the claims.

The terminology used herein is for the purpose of describing particular example embodiments only and is not intended to be limiting. As used herein, the singular forms "a," "an," and "the" may be intended to include the plural forms as well, unless the context clearly indicates otherwise. It will be further understood that the terms "comprise," "comprises," and/or "comprising," "include," "includes," and/or "including" when used in this disclosure, specify the presence of stated features, integers, steps, operations, elements, and/or components, but do not preclude the presence or addition of one or more other features, integers, steps, operations, elements, components, and/or groups thereof.

In some embodiments, when transporting an object, a packaging structure may be used to package and fix the object according to characteristics of the transported object. The packaging structure may be necessary for a long-term transportation process, especially for transporting an expensive object or a fragile object, which may significantly improve the reliability of the transportation process. For example, when transporting a glass object, a packaging liner of a packaging box may be used to fix the glass object at a certain position in the packaging box. For example, the packaging liner may be used to fix the glass object first, and then the packaging liner and the glass object may be placed in the packaging box for further fixation and protection. In some embodiments, the packaging liner and the packaging box may be designed to further provide the packaged object with cushioning protection and shockproof functions, thereby improving the reliability of the transportation process.

As shown in FIGS. 1, 2, 3*a*-3*d*, 11*a*, and 11*b*, in some embodiments, a packaging structure may include a sheet 1 and a film 20. The sheet 1 may include a base plate 10 and a first side plate 11, a second side plate 12, a third side plate 13, and a fourth side plate 14 distributed around the base plate 10. The film 20 may at least include a first fixed part and a second fixed part, respectively. The first fixed part and the second fixed part may be fixedly connected with at least two side plates of the first side plate 11, the second side plate 12, the third side plate 13, and the fourth side plate 14, respectively. The first side plate 11 may be disposed opposite to the third side plate 13. The second side plate 12 may be disposed opposite to the fourth side plate 14.

In some embodiments, the sheet 1 may be a sheet-like structure made of any material, for example, a wood sheet, a steel sheet, a corrugated paper sheet, etc. In some embodiments, the sheet 1 may also be a plate-like structure with a certain thickness, for example, a wooden plate, a card plate, etc., to better fix a packaged object. The first side plate 11, the second side plate 12, the third side plate 13, and the fourth side plate 14 may refer to sheet-like structures connected around the base plate 10. The first side plate 11, the second side plate 12, the third side plate 13, and the fourth side plate 14 may be folded relative to the base plate 10 to fix the packaged object. In some embodiments, at least one of the side plates may be integrally formed with the base plate 10. In some embodiments, at least one of the side plates may be connected with the base plate 10 by a mechanical mechanism. For example, at least one of the side plates may be connected with the base plate 10 by a hinge.

In some embodiments, the sheet 1 may further include a first side edge disposed between the base plate 10 and the first side plate 11, a second side edge disposed between the base plate 10 and the second side plate 12, a third side edge disposed between the base plate 10 and the third side plate 13, and a fourth side edge disposed between the base plate 10 and the fourth side plate 14. The first side plate 11, the second side plate 12, the third side plate 13, and the fourth side plate 14 may be connected with the base plate 10 through the first side edge, the second side edge, the third side edge, and the fourth side edge, respectively. More descriptions regarding the first side edge, the second side edge, the third side edge, and the fourth side edge may be found elsewhere in the present disclosure (e.g., FIGS. 5-6*d* and the description thereof), which is not repeated herein.

In some embodiments, the film 20 may include a fixed part 23 and a packaging part 22. The fixed part 23 may include the first fixed part and the second fixed part in the embodiments. As used herein, the fixed part 23 may refer to a part of the film 20 that is fixedly connected with (e.g., sticking to) the side plate of the sheet 1, and the packaging part 22 may refer to a part of the film 20 that forms a packaging space with the sheet 1 to accommodate or cover at least part of the packaged object. The packaging space may refer to a space formed by the packaging part 22 and the sheet 1 for accommodating the packaged object. In some embodiments, the first fixed part and the second fixed part of the film 20 may be fixed on at least two side plates. For example, the first fixed part and the second fixed part may be fixed on two adjacent or opposite side plates (as shown in FIG. 1 to FIG. 3*d*), three side plates, or four side plates. In some embodiments, the first fixed part and the second fixed part may be fixed on the side plate by a mechanical structure, for example, a rivet, a screw, etc. In some embodiments, the first fixed part and the second fixed part may be fixed on the side plate by adhering with glue, which may reduce a manufacturing cost.

In some embodiments, the film 20 may be stretched to fasten the packaged object. A stretching direction of the film 20 may be a direction from the first fixed part to the second fixed part, for example, along the longest side of the film 20 in FIG. 1. In some embodiments, the first fixed part and/or the second fixed part of the film 20 may need to have a certain width to ensure that the film 20 may be firmly adhered to the corresponding side plate. In some embodiments, a value range of the width of the first fixed part and the second fixed part may be 3 mm to 25 mm. In some embodiments, the value range of the width may be 5 mm to 20 mm. In some embodiments, the value width may be 8 mm, 10 mm, 15 mm, etc. The width of the first fixed part and/or the second fixed part may be understood as a length in a direction perpendicular to the stretching direction. For example, as shown in FIG. 1, the width of the first fixed part and/or the second fixed part may be a length in the direction from the second side plate to the second side plate.

Figure 9:
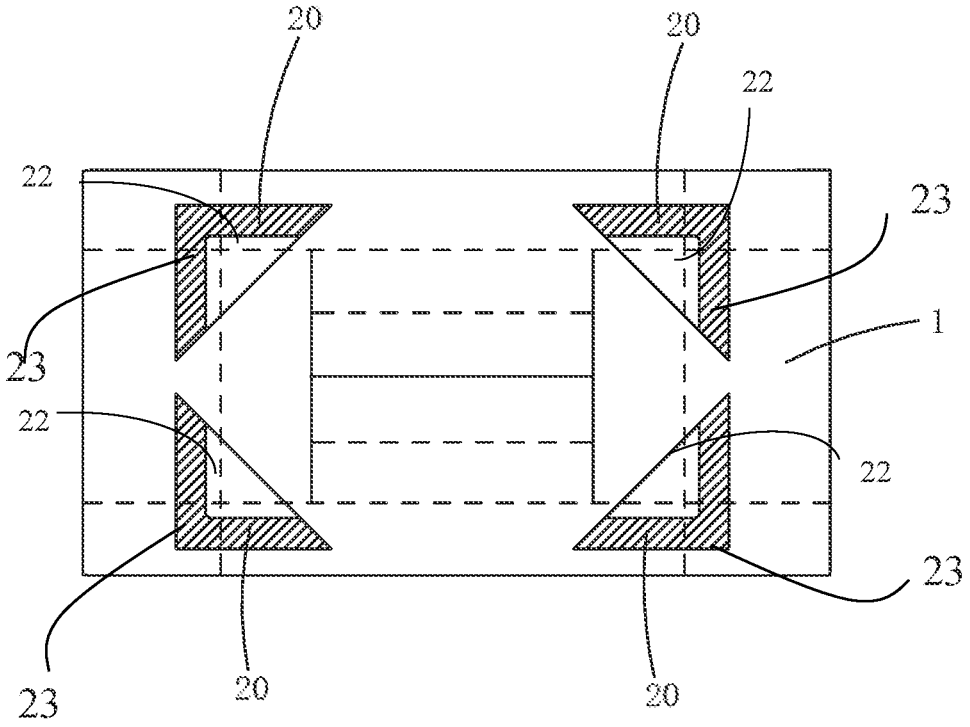
FIG. 9 is a schematic diagram of a packaging structure according to some embodiments of the present disclosure.

It should be noted that the fixed part 23, the first fixed part, and the second fixed part in the embodiment may be used to refer to the part where the film 20 may be fixed to the side plate. When the film 20 is fixed on two adjacent side plates, the first fixed part and the second fixed part may be regarded as a whole which is equivalent to the fixed part 23 (as shown in FIG. 9). When the film 20 is fixed on two opposite side plates, the first fixed part and the second fixed part may be equivalent to two fixed parts 23 at both ends of the film 20 along the stretching direction (as shown in FIG. 1).

In some embodiments, the packaging structure may achieve the fixing of the packaged object through a cooperation of the film 20 and the sheet 1. Assuming that the film 20 is disposed on the front side of the sheet, the cooperation of the film 20 and the sheet 1 may include that the side plate(s) on the sheet 1, to which the film 20 is fixed connected, may bend towards the back side of the sheet 1 to stretch the film 20 during a folding process to enable the film 20 to be in a tension state. Therefore, the object placed between the film 20 and the sheet 1 (e.g., the base plate 10) may be compressed by the stretched film 20, and thus the object between the sheet 1 and the film 20 may be fixed.

In the following, the first fixed part and the second fixed part fixed on the first side plate 11 and the third side plate 13 may be taken as an example to introduce a packaging process for the packaged object. First, the object to be packaged may be placed into the packaging space between the base plate 10 and the film 20, and then the first side plate 11 and the third side plate 13 (as shown in FIG. 1 to FIG. 3*b*) where the first fixed part and the second fixed part of the film 20 are fixed may be folded, along their corresponding side edges and facing away from the film 20, to attach the back of the base plate 10. In other words, the first side plate 11 and the third side plate 13 may be respectively folded, along the first side edge and the third side edge, towards the direction facing away from the film 20. As used herein, assuming that the film 20 is disposed on the front side of the base plate 10, that the first side plate 11 is folded towards the direction facing away from the film 20 denotes that the first side plate 11 is folded towards the back side of the base plate 10. When at least two side plates are folded in a direction facing away from the film 20, the film 20 may be stretched and in the tension state. The stretched film 20 may compress the packaged object to prevent the packaged object from moving relative to the base plate 10 during a transportation process, thereby effectively improving the reliability of the transportation process.

In some embodiments, the packaging of the object may be in the form of a corrugated box with an inner buffer strip. The inner buffer strip may be specifically designed according to the size of the packaged object, and direct contact with the packaging on all surfaces of the object. Therefore, the objects with different sizes may not be shared with the packaging, and a large area of waste may be caused for protecting the object.

In addition, the inner buffer strip may be generally made of a buffer cushion, for example, folded paper cards, polyethylene foamed cotton, polystyrene, and ethylene-vinyl acetate copolymer, expandable polystyrene, plastic molding, etc. Among the materials, a forming process of the folded paper card may be complicated resulting in low production capacity. For example, the polyethylene foam cotton and plastic molding may be of high cost and difficult for recycling, and the polystyrene, the ethylene-vinyl acetate copolymer and the expandable polystyrene may be expensive.

In some embodiments, the sheet 1 and the film 20 may be referred to as a protective liner of a film packaging. Further, by setting a cutting line on the surface of the film 20, the film 20 may form a stretched hole when stretched, thereby increasing the resistance between the film 20 and the packaged object, and effectively improving the reliability of the transportation process.

Referring to FIG. 1 to FIG. 3*d*, in some embodiments, the packaging structure may be the protective liner of the film packaging. The protective liner of the film packaging may include an base plate 10 and a film 20 located at a side of the surface of the base plate 10 to form a packaging space with the surface of the base plate 10 for accommodating the object. The base plate 10 may include a first side edge, a second side edge, a third side edge, and a fourth side edge connected in sequence. The first side edge may be opposite to the third side edge, and the second side edge may be opposite to the fourth side edge. The protective liner of the film packaging may also include a first side plate 11 connected with the first side edge, a second side plate 12 connected with the second side edge, and a third side plate 13 connected with the third side edge, and a fourth side plate 14 connected with the fourth side edge. Two ends of the film 20 may be respectively connected with the first side plate 11 and the third side plate 13. As used herein, the first side plate 11 may be folded, along the first side edge and facing away from the film 20, to attach the back of the base plate 10. The second side plate 12 may be folded, along the second side edge and facing away from the back of the base plate 10, until it is substantially perpendicular to the base plate 10. The third side plate 13 may be folded, along the third side edge and facing away from the film 20, to attach the back of the base plate 10. The fourth side plate 14 may be folded, along the fourth side edge and facing away from the back of the base plate 10, until it is substantially perpendicular to the base plate 10. That is to say, in a folding state, the first side plate 11 and the third side plate 13 may be both disposed on the front side of the base plate 10, the second side plate 12 and the fourth side plate 14 may be both disposed on the back side of the base plate 10.

FIG. 1 is an expanded structural diagram illustrating a protective liner of a film packaging according to some embodiments of the present disclosure. In some embodiments, the base plate 10 may be quadrilateral, and the first side plate 11, the second side plate 12, the third side plate 13, and the fourth side plate 14 may be sequentially connected with the first side edge, the second side edge, the third side edge, and the fourth side edge of the base plate 10 in a clockwise direction. The film 20 may be disposed on one side (e.g., the front side) of the base plate 10, and two opposite ends of the film 20 may be respectively connected with the first side plate 11 and the third side plate 13.

Figure 2:
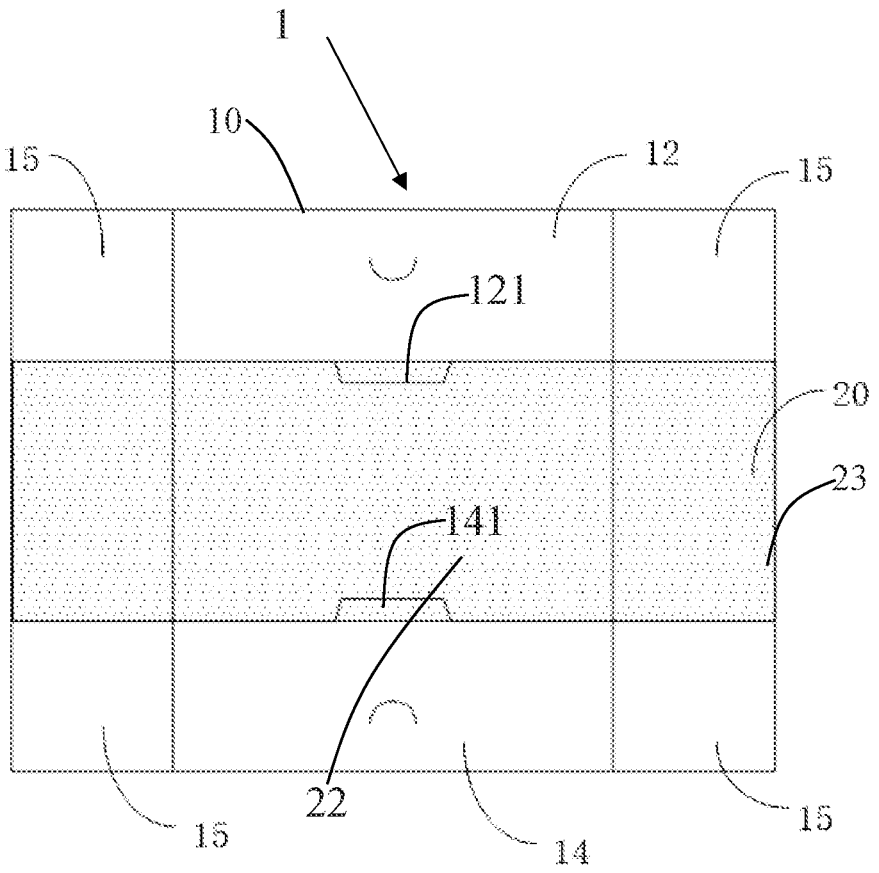
FIG. 2 is an expanded structural schematic diagram illustrating a protective liner of a film packaging with corner plates according to some embodiments of the present disclosure.

It should be noted that, as shown in FIG. 2, a corner plate 15 may be disposed between the first side plate 11 and the second side plate 12. The corner plate 15 may be connected with both the first side plate 11 and the second side plate 12. When the first side plate 11 and the second side plate 12 are folded, the corner plate 15 may be folded with the first side plate 11 and the second side plate 12 in sequence. Similarly, other corner plates 15 may also be disposed between the second side plate 12 and the third side plate 13, between the third side plate 13 and the fourth side plate 14, and between the fourth side plate 14 and the first side plate 11. In some embodiments, the corner plate 15 may not be disposed between the first side plate 11 and the second side plate 12, between the second side plate 12 and the third side plate 13, between the third side plate 13 and the fourth side plate 14, or between the fourth side plate 14 and the first side plate 11.

Figure 3A:
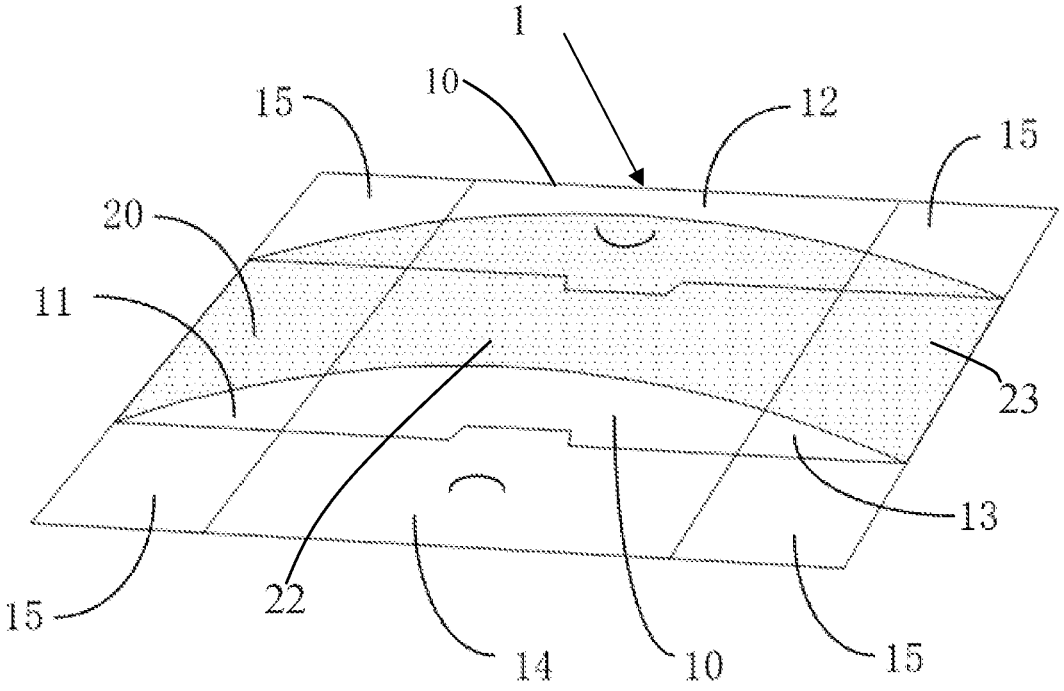
FIG. 3*a* to FIG. 3*d* are schematic diagrams illustrating a packaging process of a protective liner of a film packaging according to some embodiments of the present disclosure.
Figure 3B:
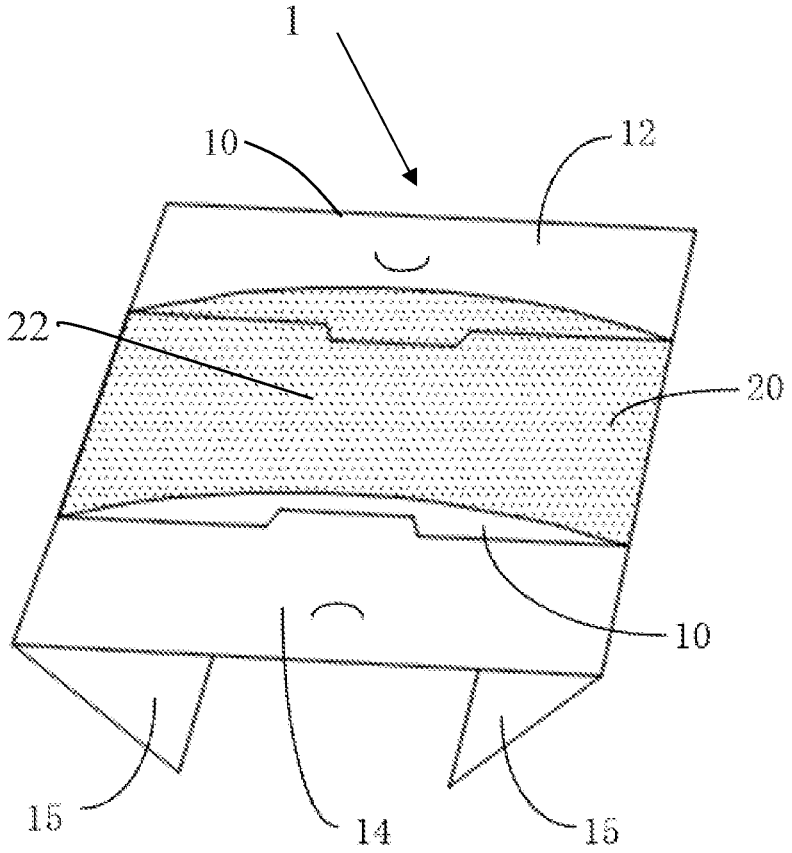
Figure 3C:
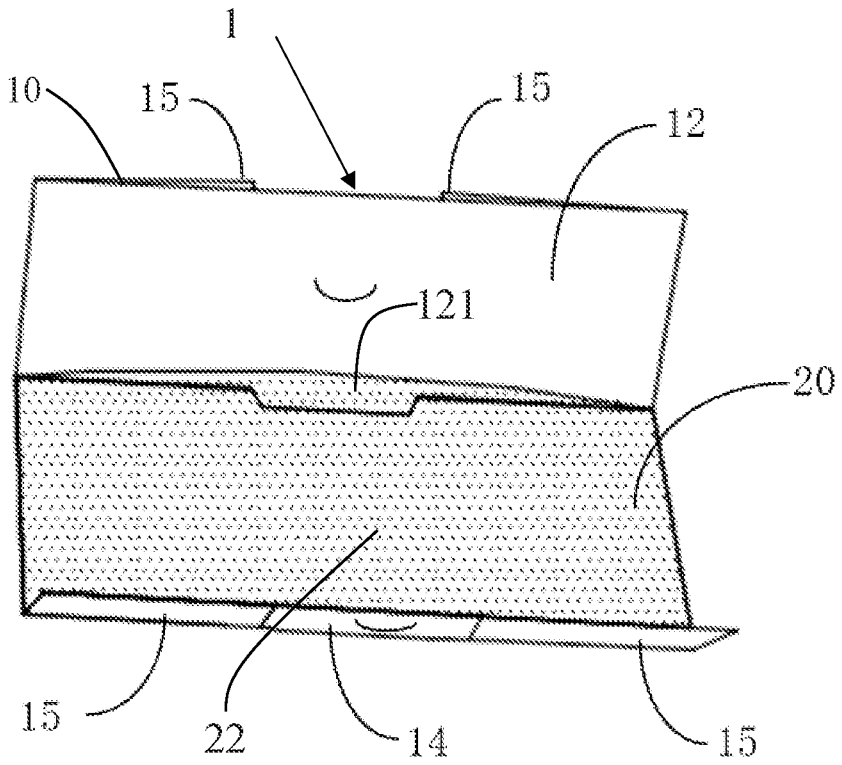
Figure 3D:
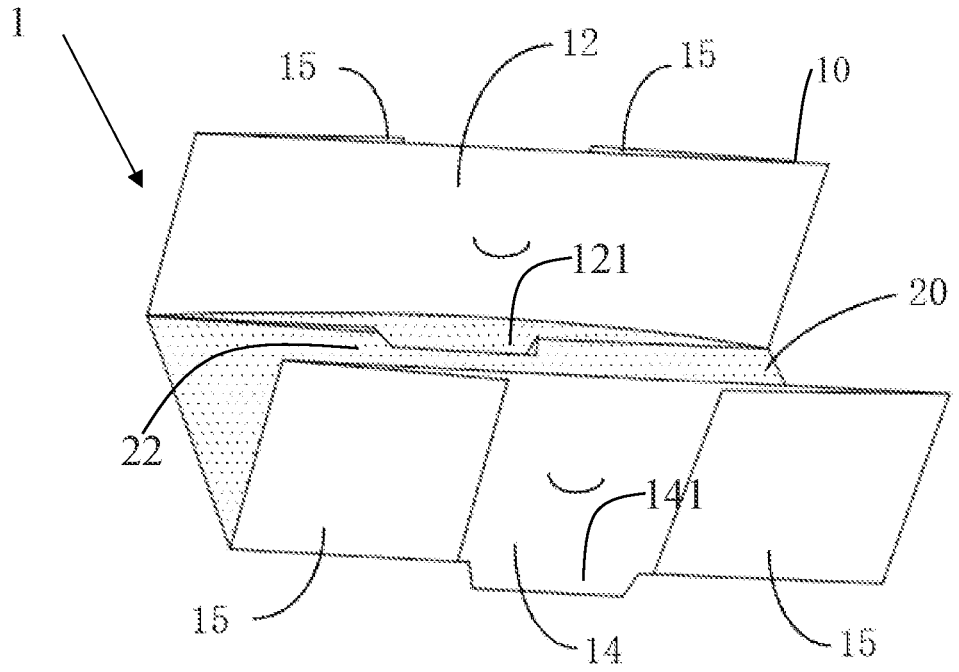

FIG. 3*a* to FIG. 3*d* are schematic diagrams illustrating a packaging process of a protective liner of a film packaging according to some embodiments of the present disclosure. The packaging process of the protective liner of the film packaging shown in FIG. 2 may be taken as an example. First, an object may be placed between the film 20 and the surface of the base plate 10 as shown in FIG. 3*a* (the object not shown). And then the first side plate 11 may be folded, along the first side edge and facing away from the film 20, to attach the back of the base plate 10, the third side plate 13 may be folded, along the third side edge and facing away from the film 20, to attach the back of the base plate 10 as shown in FIG. 3*b*. The film 20 whose both ends are connected with the first side plate 11 and the third side plate 13 may be stretched during the process. The tensioned surface of the film 20 may compress the object between the film 20 and the surface of the base plate 10 onto the base plate 10 to limit the position of the object. The film 20 and the surface of the base plate 10 may provide a strong fastening effect for the object. Subsequently, the second side plate 12 may be folded, along the second side edge and facing away from the back of the base plate 10, until it is substantially perpendicular to the base plate 10, and the fourth side plate 14 may be folded, along the fourth side edge and facing away from the back of the base plate 10, until it is substantially perpendicular to the base plate 10 as shown in FIG. 3*c*. Both of the second side plate 12 and the fourth side plate 14 may form a space above the base plate 10 to protect the object located on the surface of the base plate 10 as shown in FIG. 3*d*.

It may be seen that, in the use of the protective liner of the film packaging, because both ends of the film 20 are connected with the first side plate 11 and the third side plate 13, when the first side plate 11 and the third side plate 13 are folded facing away from the film 20, the film 20 may be stretched. The tensioned surface of the film 20 may enable the film 20 to apply greater pressure on the object between the film 20 and the surface of the base plate 10. Therefore, the object may be stably stuck between the film 20 and the base plate 10, thereby providing better cushioning and protection for the object. In addition, the protective liner of the film packaging may have advantages (e.g., a simple structure, low cost, an environmentally friendly protection, a strong versatility) and a good development prospect. The surface of the base plate 10 described herein may refer to the front side of the base plate 10 on which the film 20 is disposed, and the back of the base plate 10 may refer to the back side of the base plate 10 opposite to the front side of the base plate 10.

In some alternative embodiments, the two ends of the film 20 may be fixedly connected with the second side plate 12 and the fourth side plate 14. Different from the above operations, when the two ends of the film 20 are fixedly connected with the second side plate 12 and the fourth side plate 14, during the folding process, the second side plate 12 may need to be folded, along the second side edge and facing away from the film 20, to attach the back of the base plate 10 and the fourth side plate 14 may be folded, along the fourth side edge and facing away from the film 20, to attach the back of the base plate 10 first. The first side plate 11 and the third side plate 13 may stand up above the surface of the base plate 10 protect the object located on the surface of the base plate 10.

As shown in FIG. 1, the second side plate 12 and the fourth side plate 14 may be respectively disposed with handle holes 40. When the folding of the second side plate 12 and the fourth side plate 14 is completed, the two handle holes 40 may be convenient for staff to grasp. In some embodiments, the handle holes 40 may derive from two cutting lines disposed on the two opposite side plates. The handle hole 40 may be formed by tapping a portion of the side plate around the cutting line (as shown in FIG. 1 to FIG. 3*d*, the portion of the side plate around the cutting line is in its original position). When the handle hole 40 is not needed, the portion of the side plate around to the cutting line may be restored to the original position. In other embodiments, the handle hole 40 may also be a hole-shaped structure (not shown in the figure) opened on a side plate, which are directly disposed on the side plate without the tapping operation.

In some embodiments, the base plate 10 may further include a supporting structure. The supporting structure may be folded over and support the liner that is used to package and fix the object. In some embodiments, the base plate 10 may include a first supporting plate and a second supporting plate separated from each other. The first supporting plate may be connected with a margin of the base plate 10 through a first folding line. The second supporting plate may be connected with another margin of the base plate 10 by a second folding line. The first folding line may be disposed opposite to the second folding line.

In some embodiments, the side of the second side plate 12 for connecting with the base plate 10 may be further disposed with a first supporting plate 121 extending along the surface of the second side plate 12. The side of the fourth side plate 14 for connecting with the base plate 10 may be further disposed with a second supporting plate 141 extending along the surface of the fourth side plate 14.

As shown in FIG. 1, the first supporting plate 121 may be connected with the second side plate 12 and located in an area of the base plate 10. When the second side plate 12 is folded relative to the base plate 10, as shown in FIG. 3*c*, the first supporting plate 121 may rotate with the second side plate 12 relative to the base plate 10. Finally, the first supporting plate 121 may be located at a position below the base plate 10 and substantially perpendicular to the base plate 10, thus acting as a leg of the base plate 10 and playing a supporting role during packaging, as shown in FIG. 3*d*. Similarly, as shown in FIG. 1, the second supporting plate 141 may be connected with the fourth side plate 14 and located in the area of the base plate 10. When the fourth side plate 14 is folded relative to the base plate 10, as shown in FIG. 3*c*, the second supporting plate 141 may rotate with the fourth side plate 14 relative to the base plate 10. Finally, the second supporting plate 141 perpendicular to the base plate 10 may play a supporting role during packaging, as shown in FIG. 3*d*.

In some embodiments, the first supporting plate and the second supporting plate may also be folded relative to the base plate 10, thereby providing support for the object located on the surface of the base plate 10. It should be noted that, when the first supporting plate and the second supporting plate are used as a supporting function, two side plates (e.g., the second side plate 12 and the fourth side plate 14) disposed with the first supporting plate and the second supporting plate may act as protective walls to protect the object located on the surface of the base plate 10. The staff may choose according to the actual situation.

Figure 13:
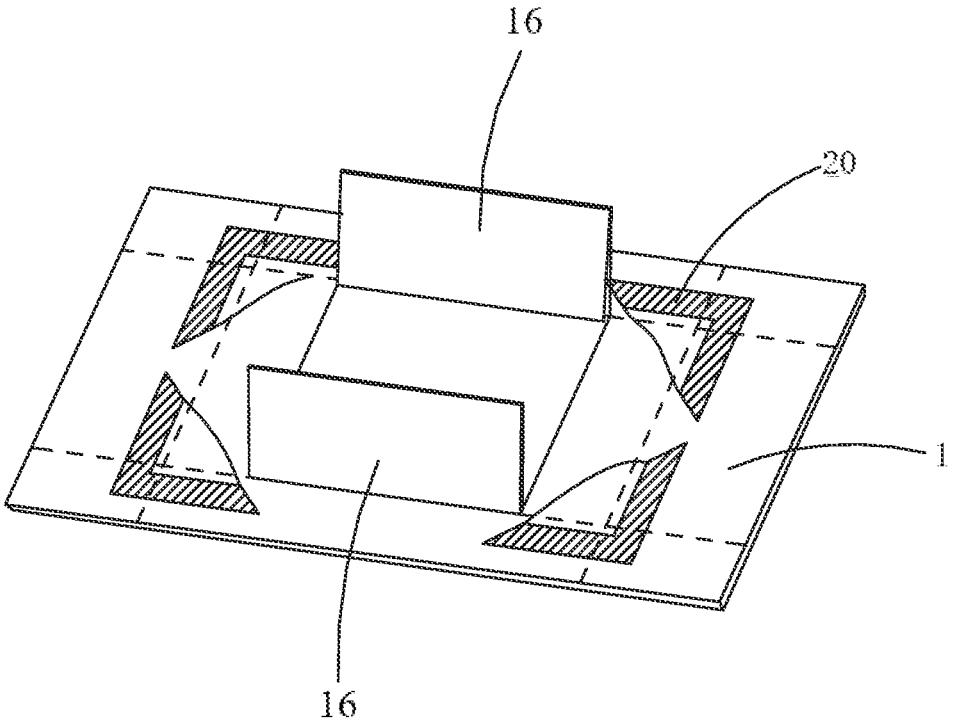
FIG. 13 is a schematic diagram illustrating a packaging structure folding up a limiting plate according to some embodiments of the present disclosure.
Figure 14:
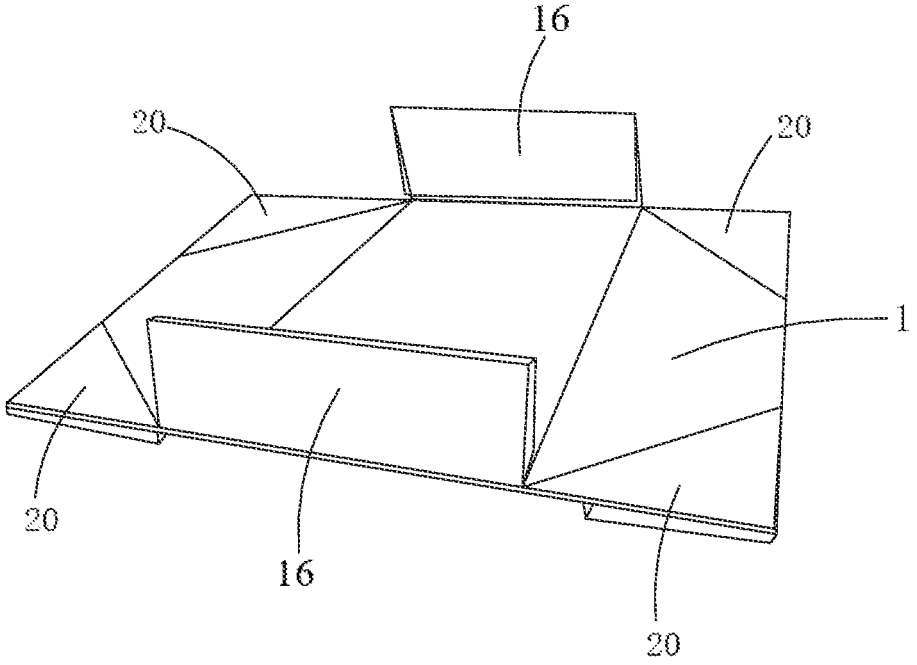
FIG. 14 is a schematic diagram illustrating a packaging structure reversely folding a sheet along a first folding mark and a second folding mark according to some embodiments of the present disclosure.
Figure 15:
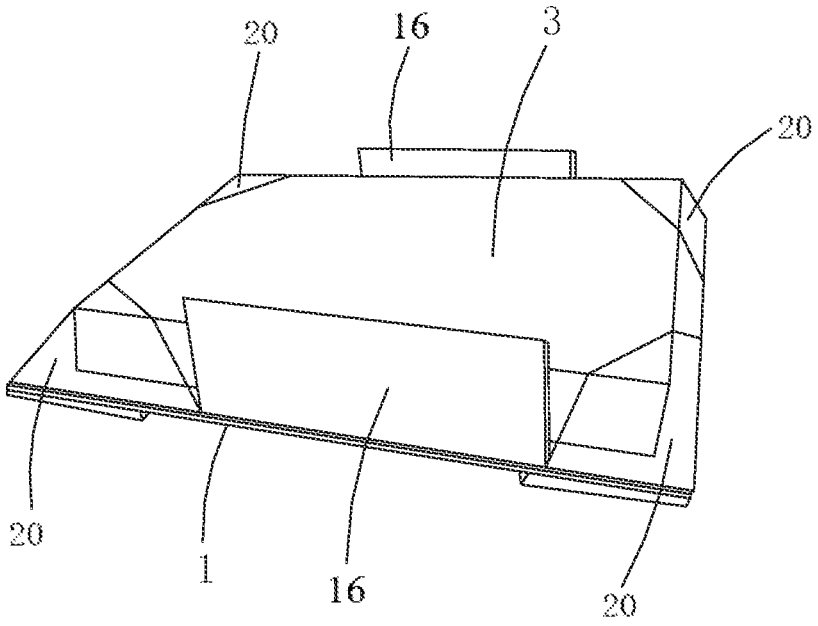
FIG. 15 is a schematic diagram illustrating a packaging structure packaging an object according to some embodiments of the present disclosure.

In other embodiments, when the first supporting plate and the second supporting plate provide support for the packaged object, the first supporting plate and the second supporting plate may also refer to two limiting plates 16 (as shown in FIG. 14) on the base plate 10. The limiting plate 16 may be used to provide support and protection for the object located on the surface of the base plate 10. More description regarding the limiting plate 16 may be found elsewhere in the present disclosure (e.g., FIGS. 13-15, and the description thereof), which is not repeated herein.

In some embodiments, in order to further improve the stretching and fastening effect of the film 20, the film 20 may be disposed with a plurality of stretching holes 21. When the film 20 is stretched, the stretching hole 21 may present a certain uneven state on its surface, thereby increasing the roughness of the film 20 and strengthening the clamping and fixing effect on the object.

FIG. 4*a* to FIG. 4*e* are schematic structural diagrams illustrating a film in a protective liner of a film package according to some embodiments of the present disclosure. Referring to FIG. 4*a* to FIG. 4*e*, in some embodiments, a plurality of cutting lines may be disposed on the film 20 to form a stretched hole. In some embodiments, a plurality of gaps may be formed in the film 20. When the film 20 is not stretched, the gaps may present a linear form. When the film 20 is stretched, a shape, such as a stretched hole, may be formed under the action of tension.

Figure 4A:
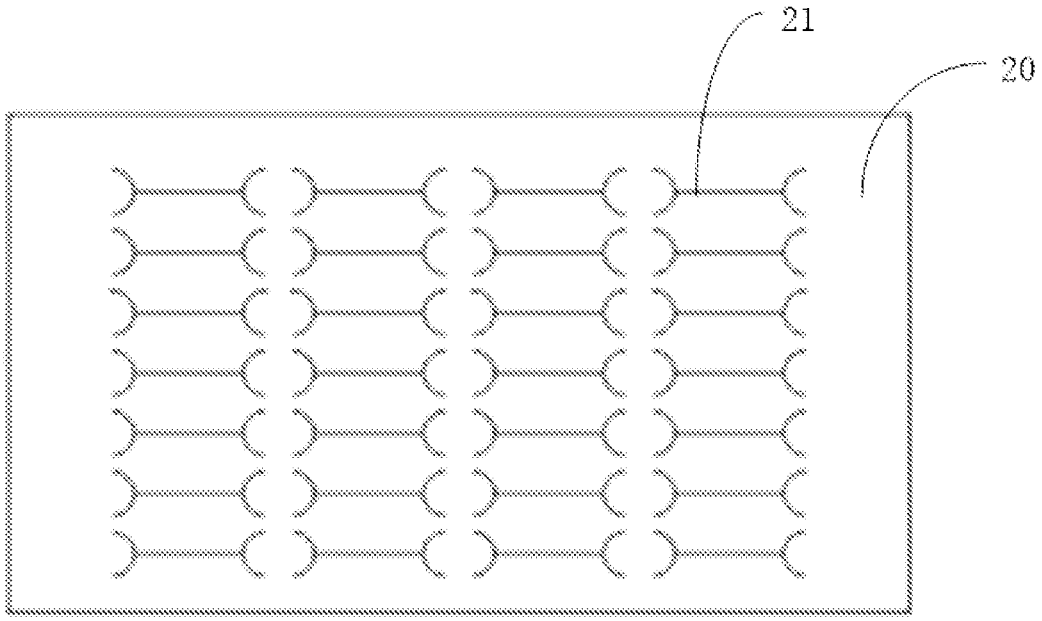
FIG. 4*a* to FIG. 4*e* are structural schematic diagrams illustrating a film in a protective liner of a film package according to some embodiments of the present disclosure.
Figure 4B:
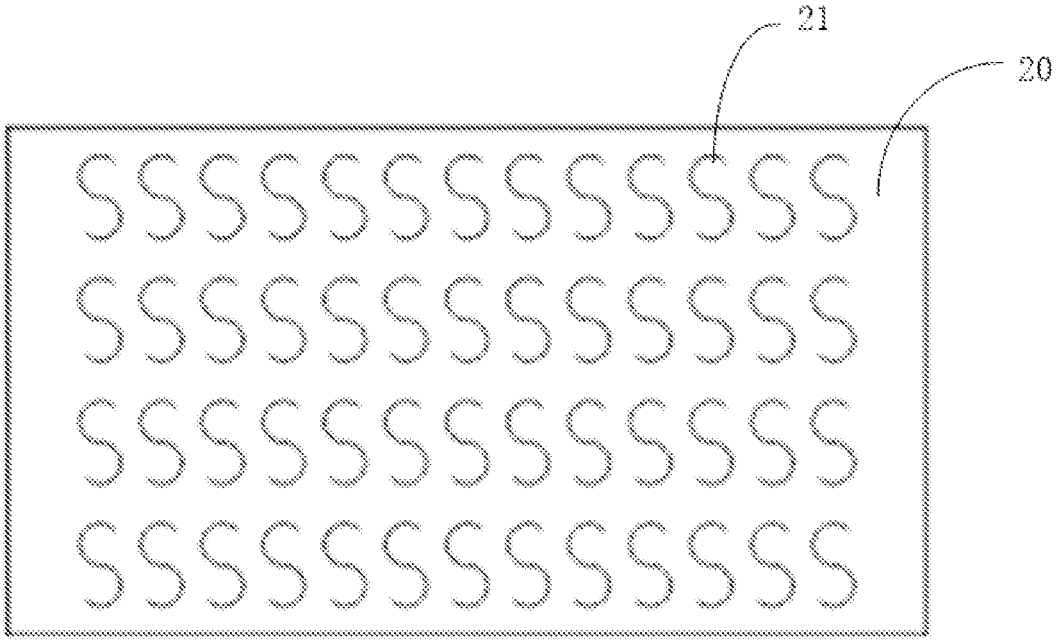
Figure 4C:
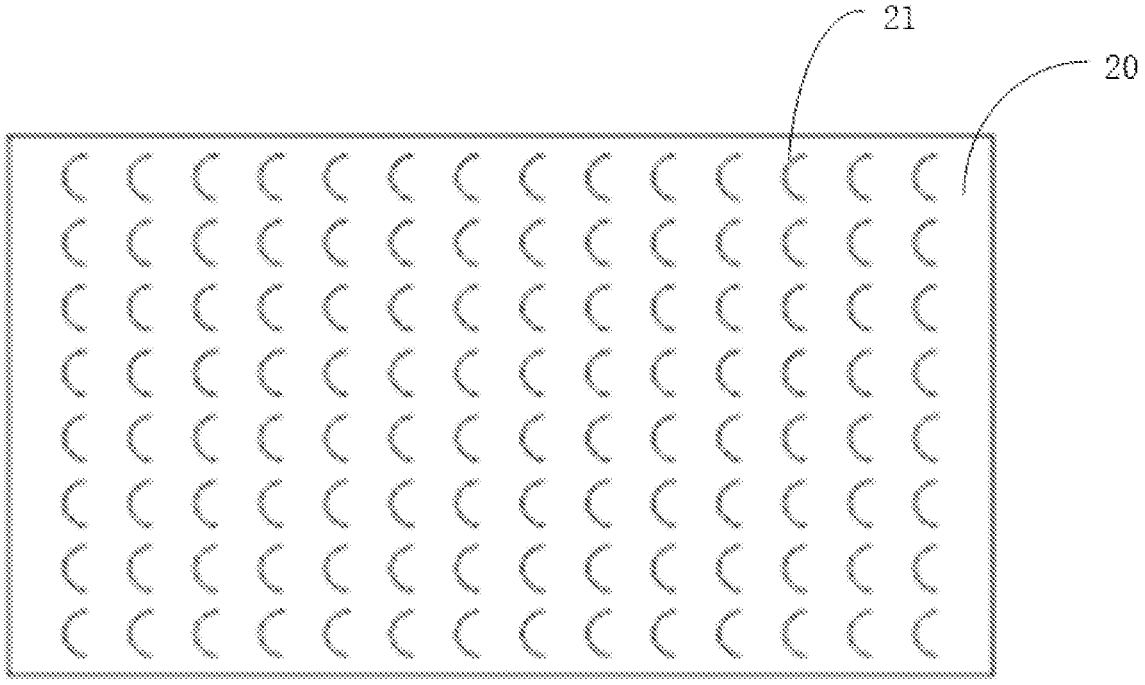
Figure 4D:
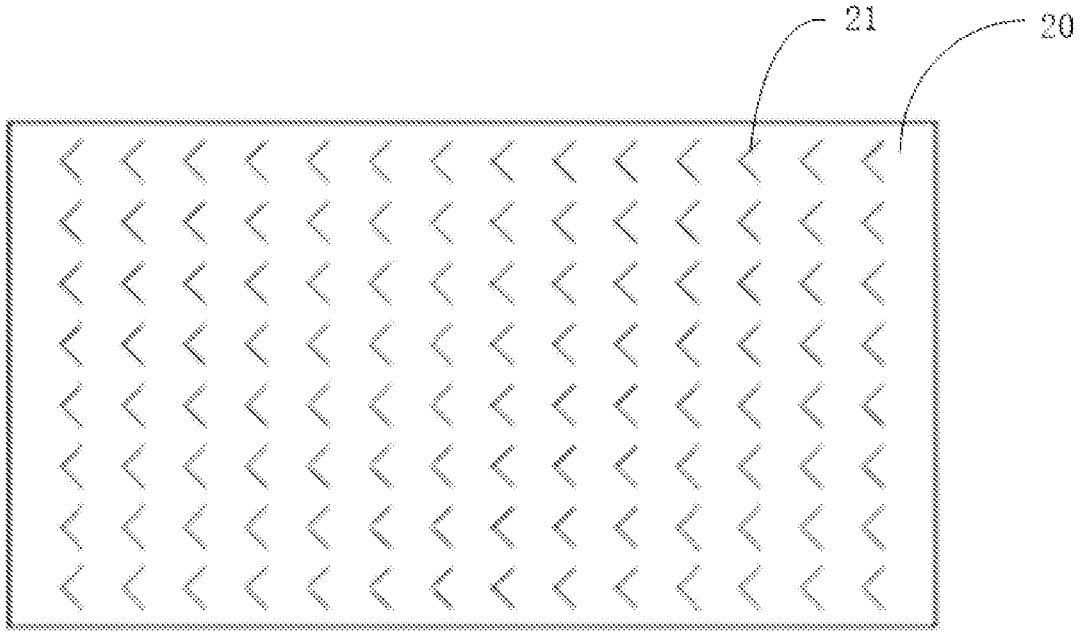
Figure 4E:
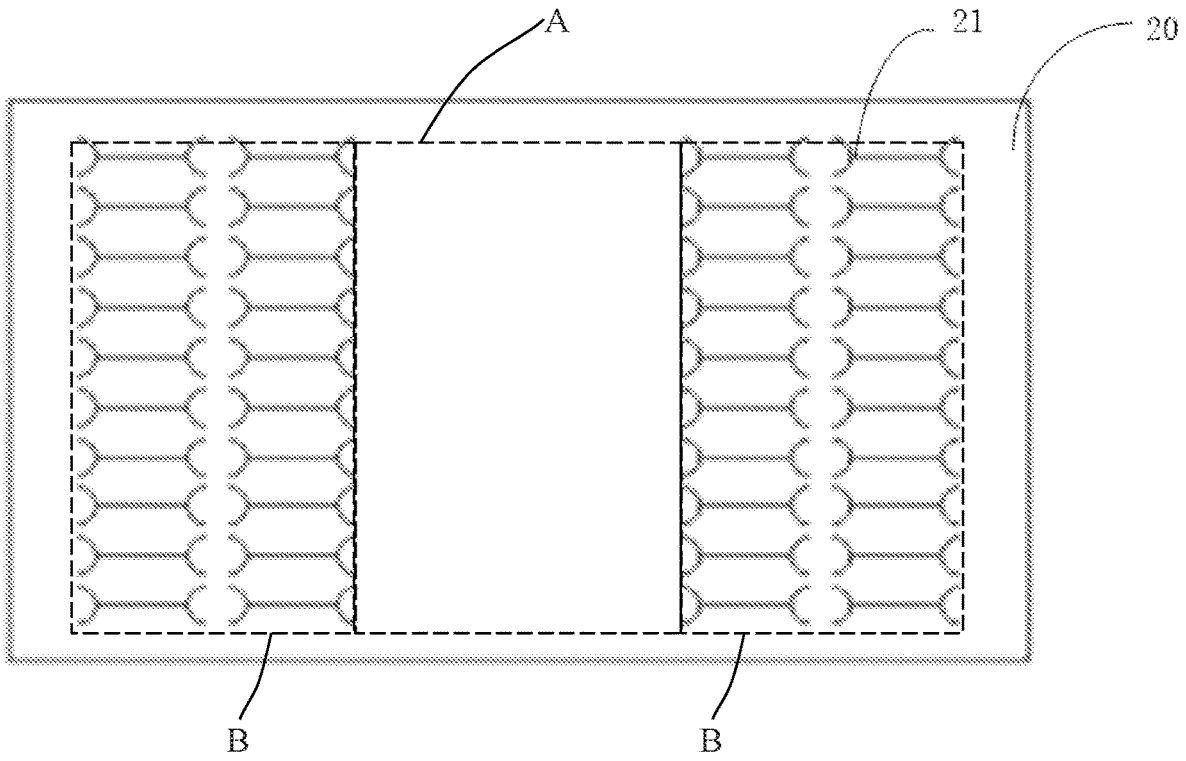

In some embodiments, the cutting line may further include a semi-arc shape (as shown in FIG. 4*c*), an angular shape (as shown in FIG. 4*d*), or two semi-arcs connected via a straight line (as shown in FIG. 4*e*).

In some embodiments, the cutting line may include an arc line and/or a straight line disposed at an angle with respect to the stretching direction of the film 20. The angle with respect to the stretching direction of the film 20 may refer to an angle between a direction of the cutting line and a direction along which the film 20 stretched (e.g., from the first side plate to the third side plate in the case of FIG. 3). When the film 20 is stretched, the stretched hole corresponding to each cutting line may be formed. When the stretched hole is in contact with the object, the stretched hole may provide greater resistance, thereby improving the reliability of transportation. For example, the shape of the stretched hole 21 may include an S-shaped linear (or arc) cut shown in FIG. 4*b*, a semi-circular (or semi-arc) cut shown in FIG. 4*c*, a polyline (or angular) cut shown in FIG. 4*d*, or the like, or any combination thereof. In some embodiments, the stretched hole 21 may use a semicircular line and a straight line (or two semicircular arcs via a straight line). As shown in FIG. 4*a*, each stretched hole 21 may include two symmetrically disposed semi-circular cuts whose bending directions are opposite, and the two semi-circular cuts may be connected by a straight cut.

In some embodiments, the shape of the plurality of cutting lines may be the same. That is, the plurality of cutting lines on the film may be of the same shape (as shown in FIG. 4*a* to FIG. 4*e*). In other embodiments, the shapes of the plurality of cutting lines may be inconsistent. That is, the plurality of cutting lines on the film 20 may be of different shapes, e.g., any combination of the shapes described in the embodiments. For example, the plurality of cutting lines may include semi-arc shaped cutting lines and angular shaped cutting lines.

It should be noted that, in the disclosure, the stretched hole 21 disposed on the film 20 may be a cutting line when not stretched, and may be any shape as shown in FIG. 4*a* to FIG. 4*e* when stretched.

Referring to FIG. 4*a* to FIG. 4*e*, in some embodiments, the cutting lines may be distributed in the entire area of the film 20 (as shown in FIG. 4*a* to FIG. 4*d*), which may effectively increase the resistance between the film 20 and the packaged object and thus improve the reliability of transportation. In some embodiments, in order to display key information of the packaged object, the cutting lines may be distributed in a non-display region of the film 20. After the packaged object is placed in the packaging space between the film 20 and the base plate 10, the packaged object may be observed through a region of the film 20. The region may include a display region (as shown in region A in FIG. 4*e*) where no stretched holes 21 are located. The non-display region may refer to other parts (as shown in region B in FIG. 4*e*) of the film 20 other than the display area. In some embodiments, the cutting lines may be evenly distributed on the film 20 or a region thereof (as shown in FIG. 4*a* to FIG. 4*e*). In some embodiments, the cutting lines may also be unevenly distributed on the film 20 or a region thereof (not shown in the figure).

In some embodiments, the count of the stretched holes 21 may be any value. The stretched holes 21 may be uniformly arrayed on the entire surface of the film 20, or distributed at both ends of the film 20 in a longitudinal direction (as shown in FIG. 4*e*). The distribution may be determined according to the object in use. For example, when the middle portion of the packaged object needs to be displayed, the stretched holes may be only distributed at one or more ends of the film 20 and a smooth region in the central region of the film 20 may be left for displaying the packaged object. As another example, when the packaged object does not need to be displayed, the stretched holes may be uniformly arrayed on the entire surface of the film 20.

The length of the film 20 along a direction from the first side plate 11 to the third side plate 13 (i.e., the horizontal direction in FIG. 1) may need to be adjusted according to the size, specifications, and properties of the object to be packaged. In some embodiments, in that direction, the length of the film 20 may be greater than or equal to the sum of the lengths of the first side plate 11, the base plate 10, and the third side plate 13. A certain gap may be reserved between the film 20 and the base plate 10 during the folding of the side plates. Therefore, the packaging space may be formed between the film 20 and the base plate 10 to accommodate at least a part (e.g., a center part, an angular part, etc.) of the packaged object. In other embodiments, the length of the film 20 may be less than the sum of the lengths of the first side plate 11, the base plate 10, and the third side plate 13. For example, when the elasticity of the film 20 is large, the film 20 may be elastically deformed by manually stretching the film 20 to put the packaged object into the packaging space. Since the volume of the packaging space is smaller than the packaged object, the film 20 may be elastically deformed before the packaged object is placed in the packaging space. Therefore, after the object is placed, an elastic force may still be present between the film 20 and the object, which may increase the resistance between the film 20 and the object, thereby further improving the reliability of transportation.

It should be noted that the width of the film 20 is not limited, and may be selected according to packaging needs. As shown in FIG. 1, the width of the film 20 may be less than the width of the base plate 10. As shown in FIG. 2, the width of the film 20 may be equal to the width of the base plate 10. In some embodiments, the width of the film 20 may be larger than the width of the base plate 10. The width of the film 20 may be understood as the length in a direction perpendicular to the stretching direction of the film 20. For example, in FIG. 1, the width of the film 20 may be the length along the direction from the second side plate 12 to the fourth side plate 14.

In some embodiments, the film 20 may be made of thermoplastic polyurethane elastomer rubber, which may have the advantages of high strength, high toughness, and wear resistance, and may provide a better fastening effect for the object.

It should be noted that the length and width of the film 20 may refer to the length and width of the film 20 in a normal state, that is, the length and width of the film in an unstretched state.

In some embodiments, the packaging structure may be further provided with a box body plate assembly. The box body plate assembly may include a box base plate 30, a first folding plate 31, a second folding plate 32, a third folding plate 33, and a fourth folding plate 34. The first folding plate 31, the second folding plate 32, the third folding plate 33, and the fourth folding plate 34 may be distributed around the box base plate 30. As used herein, the first folding plate 31 may be disposed opposite to the third folding plate 33, and the second folding plate 32 may be disposed opposite to the fourth folding plate 34. The fourth folding plate 34 may be connected with the sheet 1 at a side facing away from the box base plate 30. The box base plate 30 may refer to a plate-like structure that may be folded to form a box body in a certain manner. The first folding plate 31, the second folding plate 32, the third folding plate 33, and the fourth folding plate 34 may refer to a plate-like structure that serves as a sidewall of the box body after being folded in a certain manner.

In some embodiments, the first folding plate 31, the second folding plate 32, the third folding plate 33, and the fourth folding plate 34, which are foldable relatively to the box base plate 30 in a direction facing away from the back of the box base plate 30, may be disposed in sequence around the box base plate 30. The side of the second folding plate 34 facing away from the box base plate 30 may be connected with a cover plate 35 opposite to the box base plate 30. The side of the fourth folding plate 34 facing away from the box base plate 30 may be connected with the side of the fourth side plate 14 facing away from the base plate 10.

Figure 5:
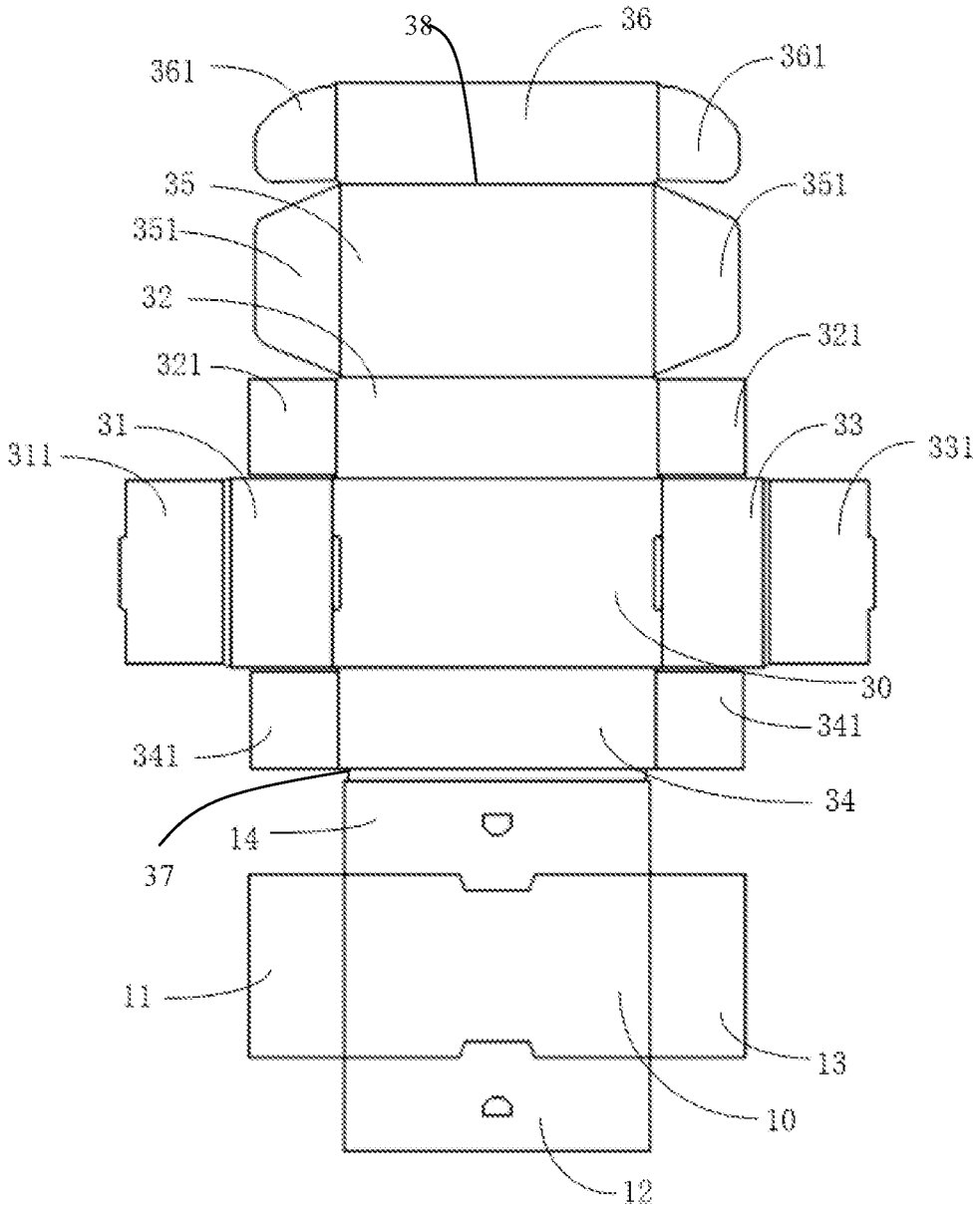
FIG. 5 is an expanded structural schematic diagram illustrating another protective liner of a film packaging according to some embodiments of the present disclosure.

In some embodiments, the fourth side plate 14 of the sheet 1 may be connected with the fourth folding plate 34 by a first folding connecting plate 37 (as shown in FIG. 5). The first folding connecting plate 37 may refer to a connecting plate with a certain width for folding and overturning of the base plate 10. In some embodiments, the fourth side plate 14 of the sheet 1 may also be connected with the fourth folding plate 34 by a first folding mark (not shown in the figure). That is, the base plate 10 and the fourth folding plate 34 may be integrally formed. A folding mark may be presented between the base plate 10 and the fourth folding plate 34. The base plate 10 may be folded relative to the fourth folding plate 34 along the folding mark.

In some embodiments, the box body plate assembly may further include a cover plate 35 disposed at a side of the second folding plate 32 facing away from the box base plate 30. After the box body plate assembly is folded to form a box body, the cover plate 35 may be disposed opposite to the box base plate 30 and used as a box cover of the box body. The liner connected with the box body plate may be placed in the box body after the box body plate assembly is folded to form the box body. In other embodiments, the box body may not be disposed with a box cover, that is, the cover plate 35 may not be disposed in the box body plate.

In some embodiments, the cover plate 35 may be integrally formed with the second folding plate 32, and a second folding mark 38 may be presented between the cover plate 35 and the second folding plate 32 (as shown in FIG. 5). The cover plate 35 may be folded relative to the second folding plate 32 along the second folding mark 38. In some alternative embodiments, the cover plate 35 may be connected with the second folding plate 32 by a second folding connecting plate (not shown in the figure). In other embodiments, the cover plate 35 may also be an independent component. For example, after the box body plate is folded to form a box body with an opening, the cover plate 35 may be directly placed at the opening of the box body or removed away at any time.

In some embodiments, the cover plate 35 may be disposed opposite to the box base plate 10 in a folding state. As used herein, the folding state may refer to a state that multiple components (e.g., the box base plate 30, the first folding plate 31, the second folding plate 32, the third folding plate 33, the fourth folding plate 34, etc.) of the box body plate assembly are folded to form the box body. The opposite disposition may be understood as that, after multiple components of the box body plate assembly are folded to form a closed box, the cover plate 35 and the box base plate 30 may be on opposite sides. That is, the cover plate 35 and the box base plate 30 may be the top and the bottom of the box body, respectively. The protective liner described above may refer to a component for packaging and fixing the object, and may be further accommodated in the box body and protected by the box body. For example, the protective liner may be the component composed of the sheet 1 and the film 20 in the above embodiment for packaging and fixing the object.

In some embodiments, the sheet 1 may also be connected with other folding plates. For example, the side of the fourth side plate 14 facing away from the base plate 10 may be connected with the second folding plate 32, and the cover plate 35 may be connected with the fourth folding plate 34.

Referring to FIG. 5, FIG. 5 is a schematic diagram illustrating an expanded structure of a protective liner with a box body plate assembly. The first folding plate 31 may be connected with a first auxiliary folding plate 311 at a side facing away from the box base plate 30. The third folding plate 33 may be connected with a third auxiliary folding plate 331 at a side facing away from the box base plate 30. Two sides of the second folding plate 32 may be respectively connected with a second folding ear plate 321. Two sides of the fourth folding plate 34 may be respectively connected with a fourth folding ear plate 341. The cover plate 35 may be connected with a packaging plate 36 at a side facing away from the second folding plate 32. Two sides of the cover plate 35 may be respectively connected with a cover plate ear plate 351. Two sides of the packaging plate 36 may be respectively connected with an encapsulated ear plate 361. When the box body plate assembly is unfolded as shown in FIG. 5, the viewed side of the box base plate 30 is the front side of the box base plate 30, while the front side of the base plate 10 on which the film 20 is disposed is facing towards the inside of the paper, and the film 20 may be located on the opposite side of the viewed side of the base plate 10, the first side plate 11, and the third side plate 13. That is, the front side of the box base plate 30 is opposite to the front side of the base plate 10.

The cover plate ear plate and the packaging ear plate may refer to components for fixing two adjacent folding plates during a process of folding the box body plate to form the box body. For example, the first folding plate 31 and the second folding plate 32 may be fixedly connected via the second folding ear plate 321 therebetween. As another example, the second folding plate 32 and the third folding plate 33 may be fixedly connected via the second folding ear plate 321 therebetween. More description regarding the ear plate may be found elsewhere in the present disclosure, which is not be repeated herein.

The packaging plate 36 may refer to a component that prevents the side of the cover plate 35 away from the second folding plate 32 from being separated from the box body. After folding to form the box body, the packaging plate 36 and the fourth folding plate 34 may be attached to each other. The encapsulated ear plates 361 disposed at both sides of the packaging plate 36 may effectively prevent the cover plate 35 from being separated from the box body, and improve the reliability of transportation.

Figure 6A:
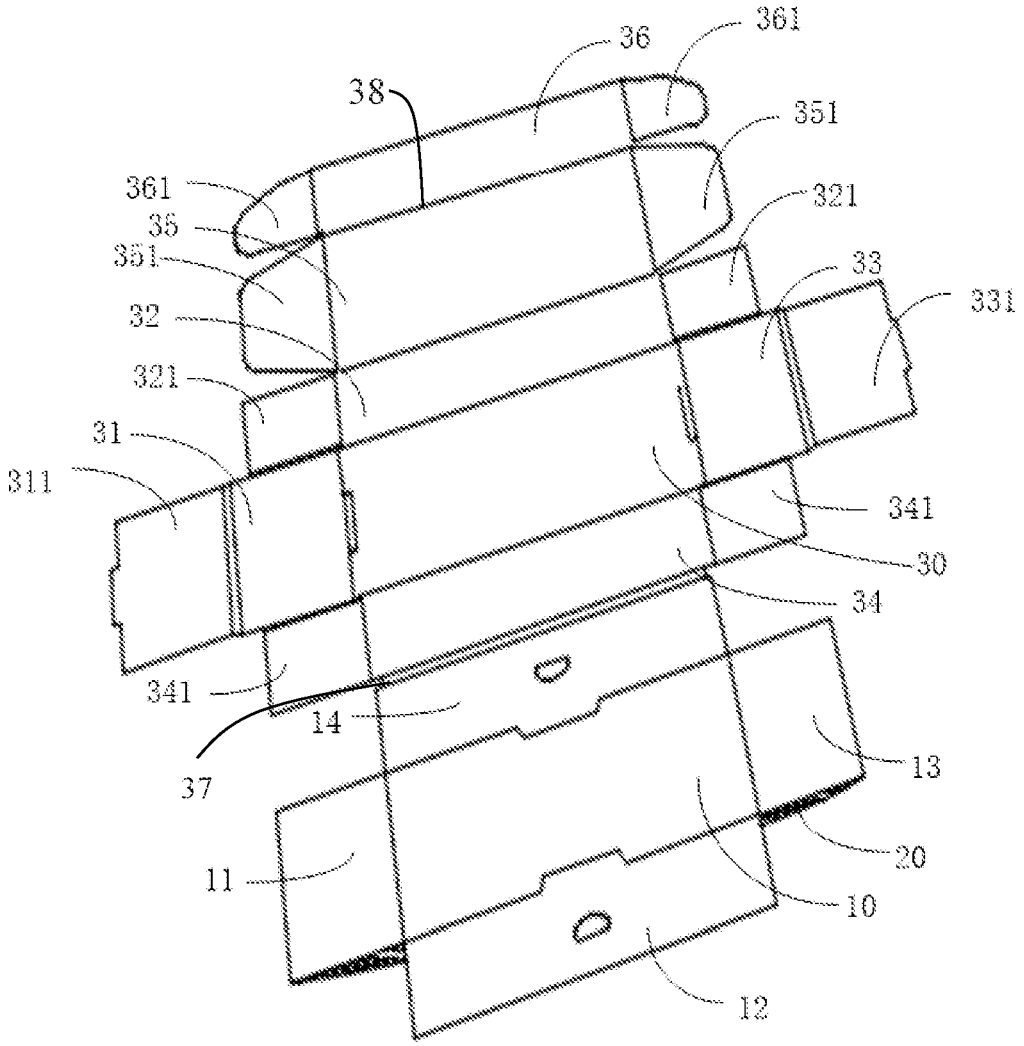
FIG. 6*a* to FIG. 6*f* are schematic diagrams illustrating a packaging process of another protective liner of a film packaging according to some embodiments of the present disclosure.
Figure 6B:
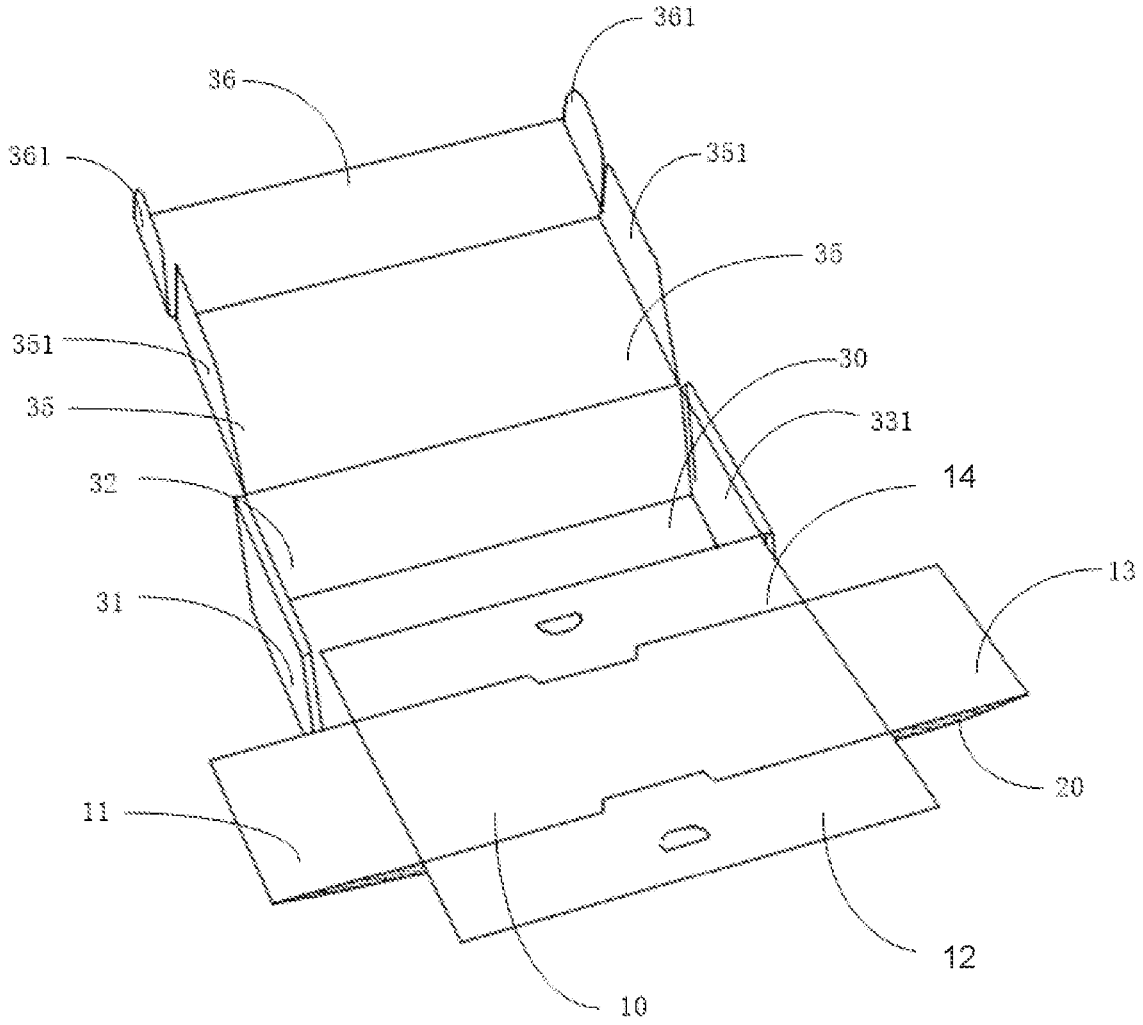
Figure 6C:
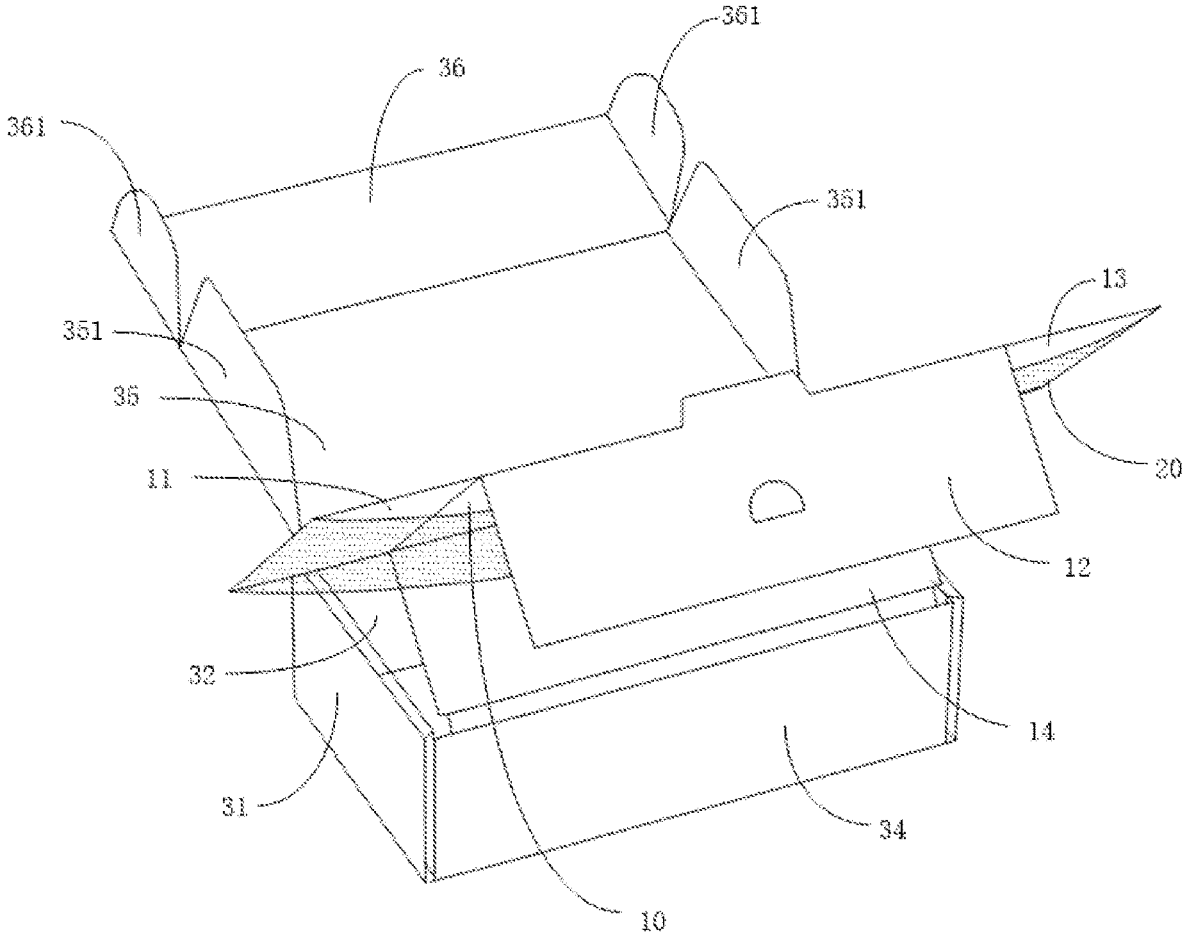
Figure 6D:
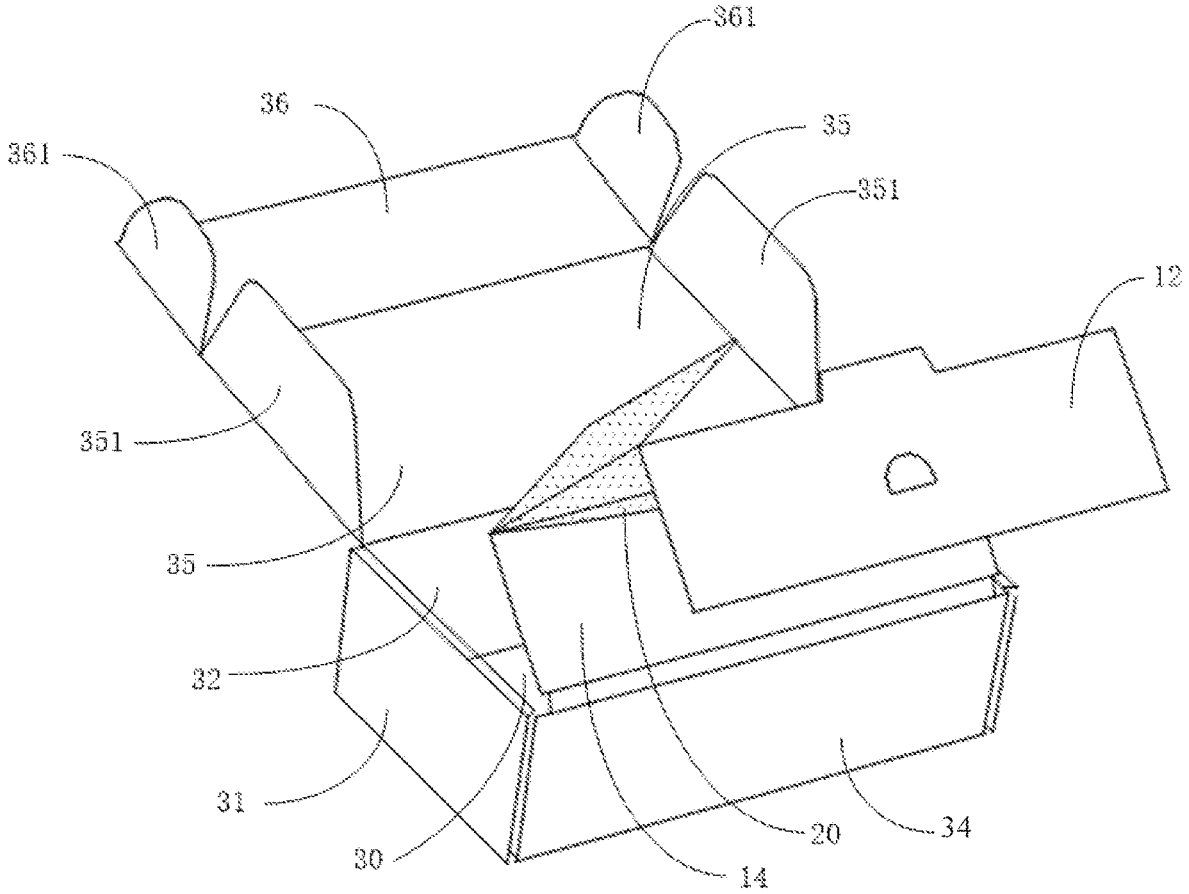

The box body plate assembly may be folded to form a box body. Referring to FIG. 6*a* to FIG. 6*f*, a folding process may include the following operations. The box base plate 30 may be taken as a center. The first auxiliary folding plate 311 may be folded relative to the first folding plate 31 to fit the surface of the first folding plate 31. The third auxiliary folding plate 331 may be folded relative to the third folding plate 33 to fit the surface of the third folding plate 33. The first folding plate 31, the second folding plate 32, the third folding plate 33, and the fourth folding plate 34 may be folded in a direction facing away from the back of the box base plate 30 until they are perpendicular to or substantially perpendicular to the box base plate 30. The two second folding ear plates 321 may be inserted into a gap between the first auxiliary folding plate 311 and the first folding plate 31 and a gap between the third auxiliary folding plate 331 and the third folding plate 33, respectively. The two fourth folding ear plates 341 may be inserted a gap between the first auxiliary folding plate 311 and the first folding plate 31 and a gap between the third auxiliary folding plate 331 and the third folding plate 33, respectively. Therefore, a box body as shown in FIG. 6*b* may be formed. At this time, the first side plate 11, the second side plate 12, the third side plate 13, and the fourth side plate 14 may be folded relative to the base plate 10 (as shown in FIG. 6*c* and FIG. 6*d*) according to the previous folding approach. Then, the fourth side plate 14 connected with the fourth folding plate 34 may be folded towards the inner side of the box body relative to the fourth folding plate 34. The base plate 10, the first side plate 11, the second side plate 12, the third side plate 13, and the fourth side plate 14 may be accommodated in the box body of the box body plate assembly, so that the fourth side plate 14 may be attached to the fourth folding plate 34, the second side plate 12 may be attached to the second folding plate 32, and the first side plate 11, the third side plate 13, and the base plate 10 may be attached to the box base plate 30 to obtain the structure shown in FIG. 6*e*.

Figure 6E:
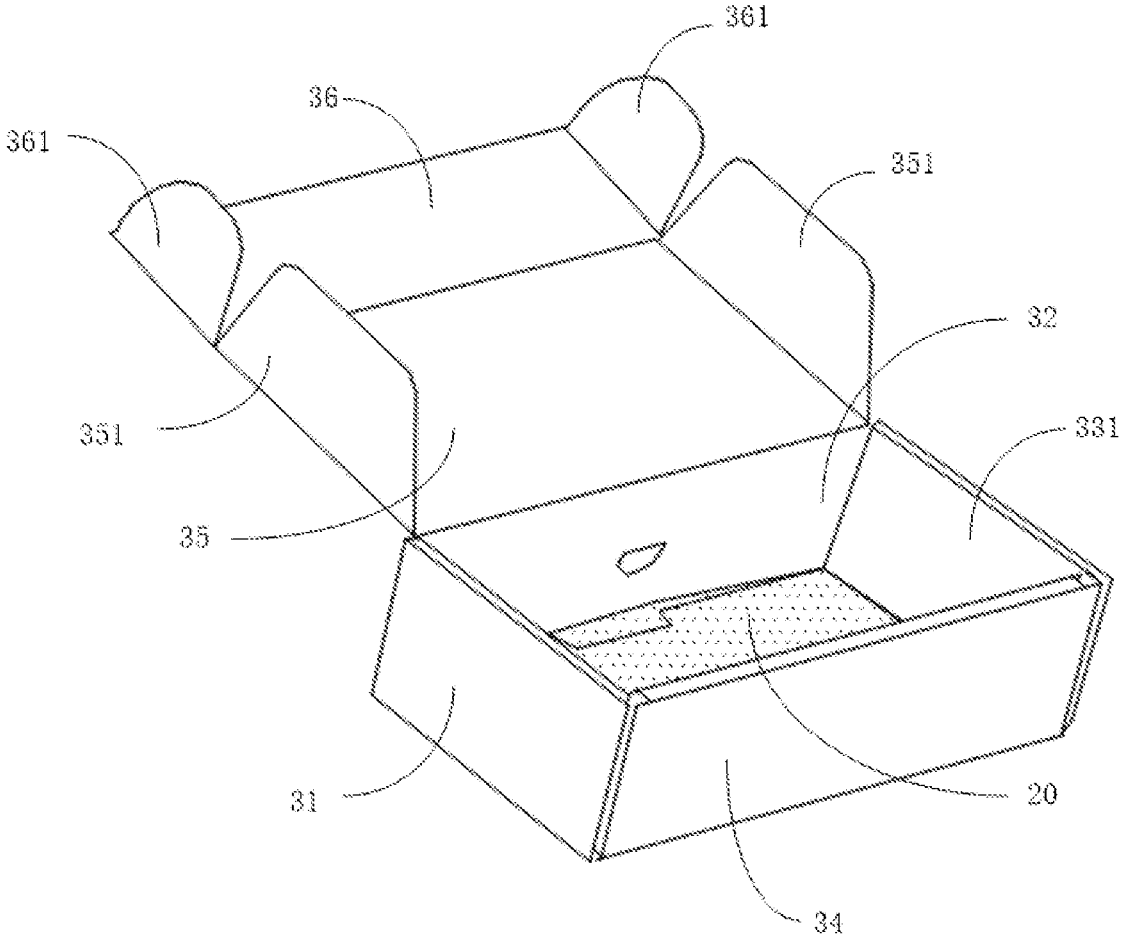
Figure 6F:
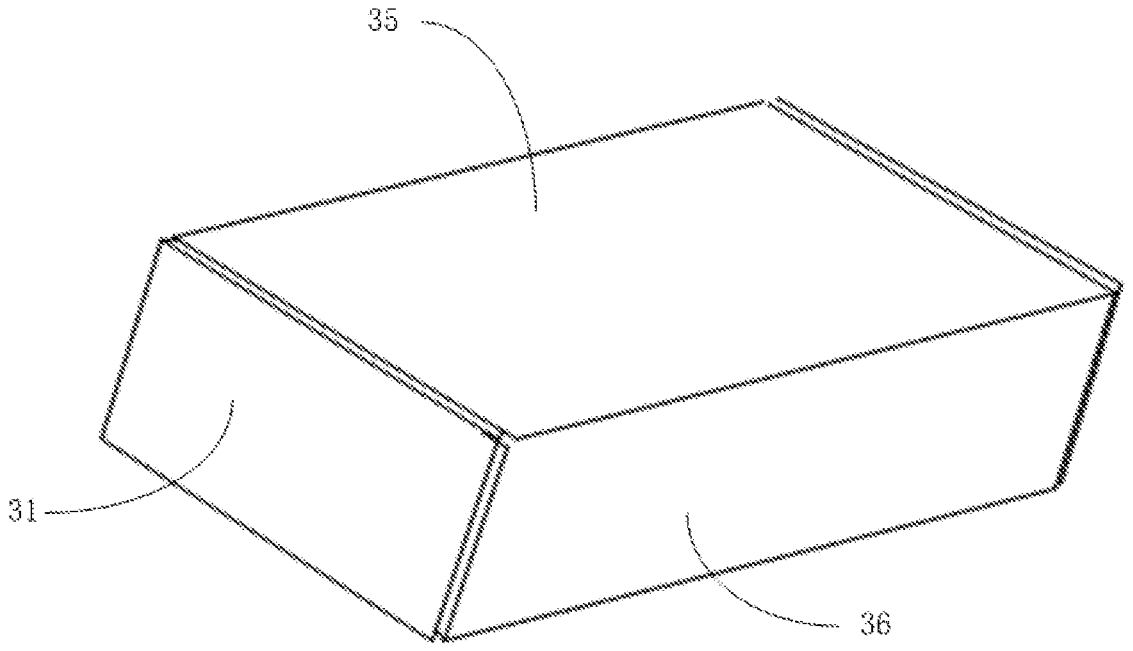

In some embodiments, when the box body plate assembly is not provided with the cover plate 35, the box body plate may be folded to form the structure shown in FIG. 6*e* without the cover plate 35. In other embodiments, when the box body plate assembly is provided with the cover plate 35, after the above folding operations, the cover plate 35 may be folded relative to the second folding plate 32 to be opposed to the box base plate 30, and two cover plate ear plates 351 may be inserted inside the box body. Further, when the box body plate assembly is provided with the packaging plate 36, after the above folding operations, the packaging plate 36 may be folded relative to the cover plate 35 to attach an outside surface of the fourth folding plate 34. The two packaging ear plates 361 may be inserted into the gap between the first auxiliary folding plate 311 and the first folding plate 31 and the gap between the third auxiliary folding plate 331 and the third folding plate 33, respectively, to form the structure shown in FIG. 6*f*. The packaging plate 36 may prevent the cover plate 35 from being separated from the box body, and improve the reliability of transportation.

In other embodiments, when the box body plate is provided with the cover plate 35 but without the packaging plate 36, a box body with the cover plate 35 may be formed after the above folding operations. The present disclosure may not limit the specific folding order or folding approach, as long as the box body plate assembly may be folded into a box body and the liner (i.e., the protective liner of the film packaging) may be placed therein.

It should be noted that, before folding the protective liner of the film packaging (e.g., the liner shown in FIG. 1 to FIG. 3*d*), the object may be placed between the base plate 10 and the film 20 so that the object may be located in the packaging space. The bottom of the object may be buffered and protected by the base plate 10 and the box base plate 30, and the top of the object may be protected and fixed by the cover plate 35 and the film 20. The whole object may be protected by the protective liner of the film packaging and the box body simultaneously, achieving a reliable packaging effect.

In some embodiments, if multiple objects are to be packaged, a double-layer liner may be used. Each layer of the liner may serve as a separate packaging component to form an independent packaging space, thereby improving the efficiency of packaging and transportation. Optionally, one layer of the double-layer liner may be used to package an individual object, and the other layer may provide buffering protection. Similarly, the double-layer liner may also be used in combination with the box body plate assembly in the above embodiment. That is, when the box body plate assembly is folded to form a box body, the double-layer liner may be placed into the box body, which may also improve the efficiency of packaging and transportation.

Figure 7:
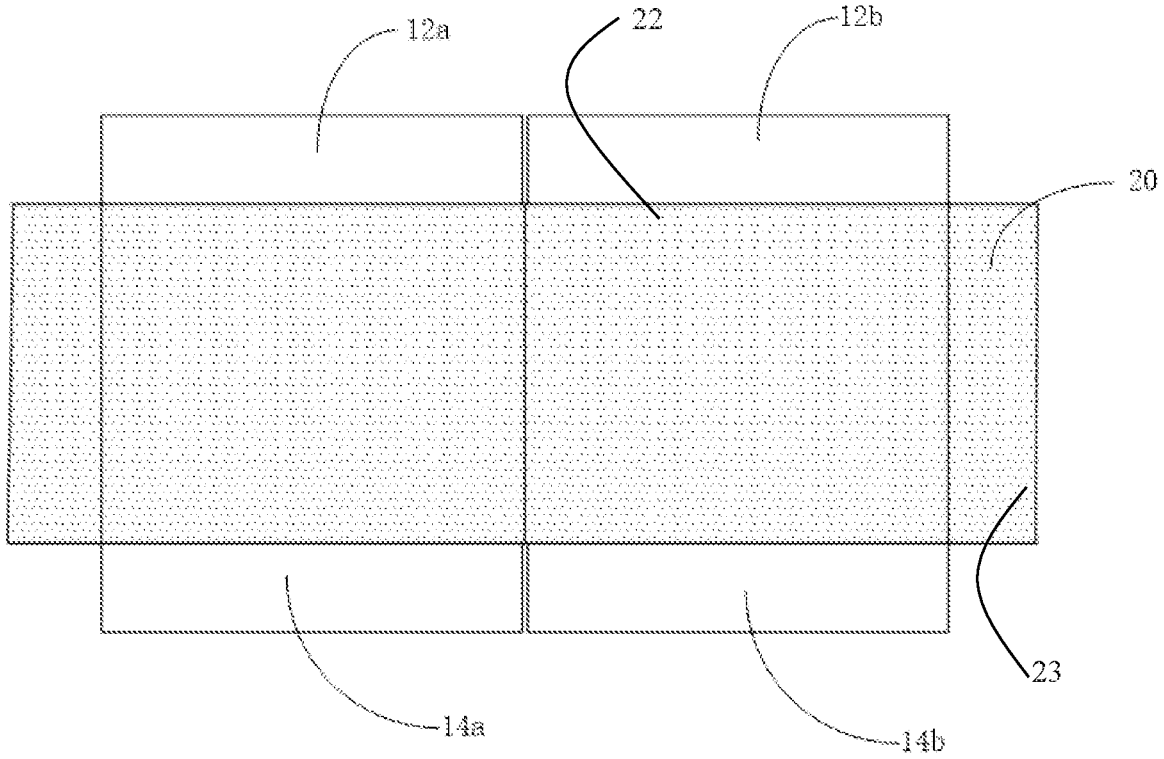
FIG. 7 is an expanded structural schematic diagram illustrating another protective liner of a film packaging according to some embodiments of the present disclosure.
Figure 8A:
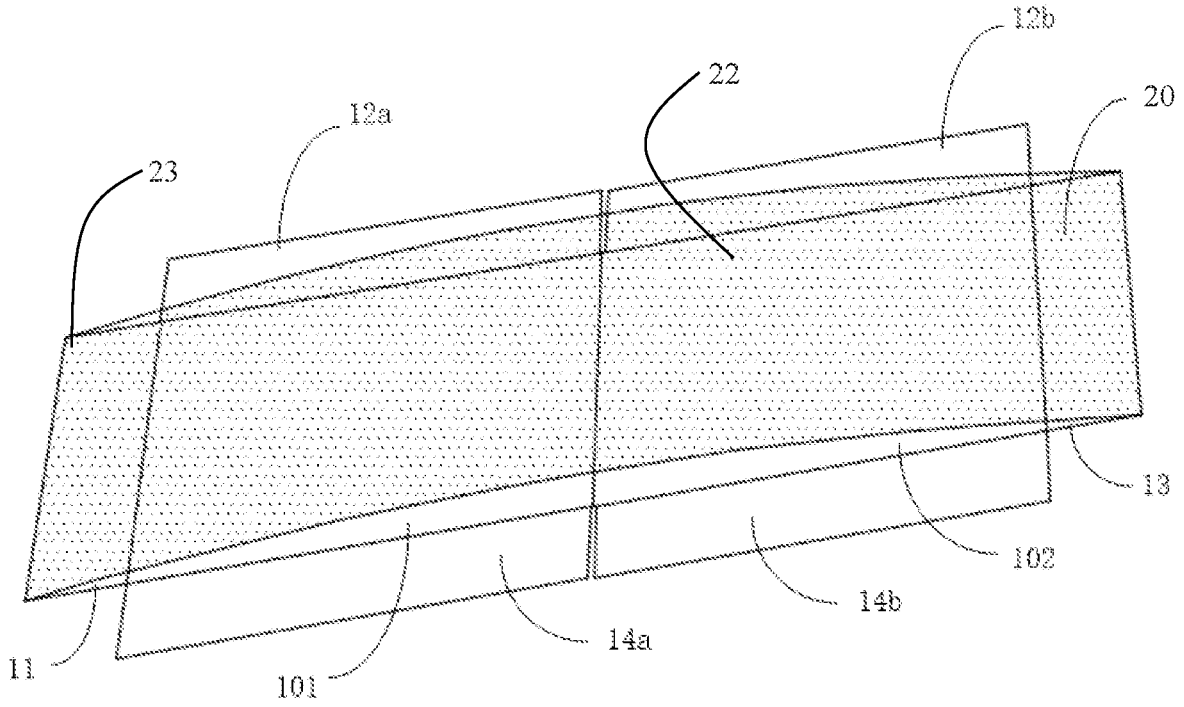
FIG. 8*a* to FIG. 8*d* are schematic diagrams illustrating a packaging process of yet another protective liner of film packaging according to some embodiments of the present disclosure.
Figure 8B:
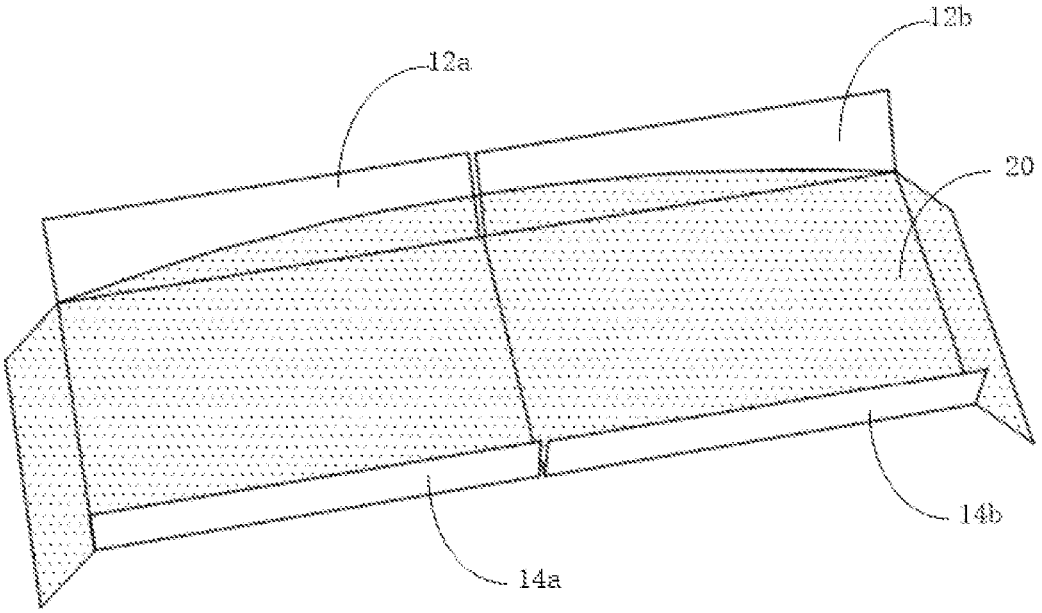
Figure 8C:
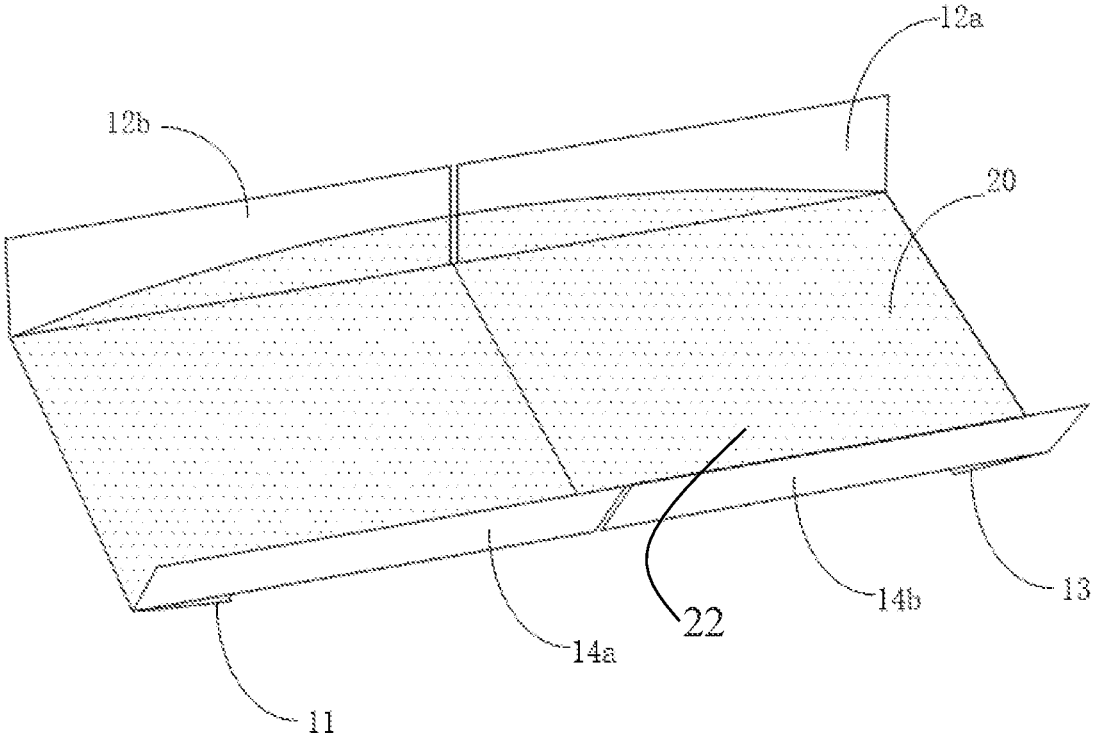
Figure 8D:
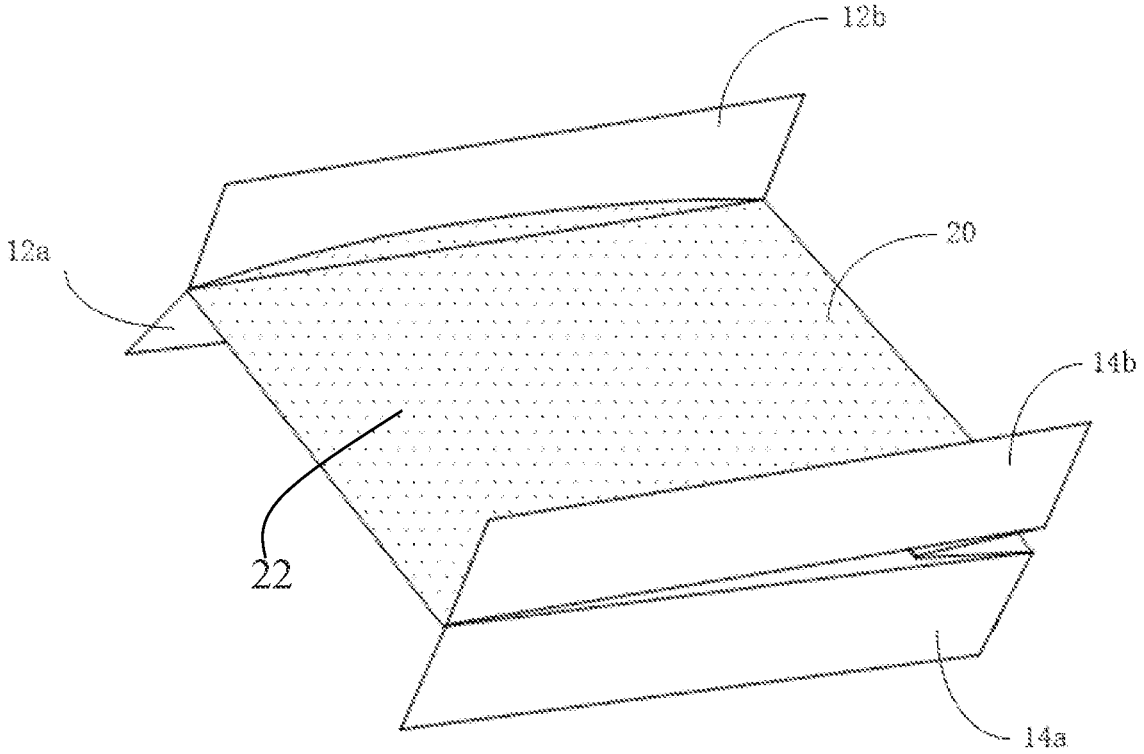

Referring to FIG. 7 to FIG. 8*d*, in some embodiments, the base plate 10 may include a first sub-base plate and a second sub-base plate. A folding line may be disposed between the first sub-base plate and the second sub-base plate. The second side plate 12 may include two second sub-side plates 12*a* and 12*b* separated from each other and disposed on either side of the folding line. The fourth side plate 14 may include two fourth sub-side plates 14*a* and 14*b* separated from each other and disposed on either side of the folding line.

In some embodiments, the packaging structure may also be a double-layer protective liner of a film packaging. Based on the embodiments shown in FIG. 1 to FIG. 3*d*, the base plate 10 may include a first sub-base plate 101 and a second sub-base plate 102 disposed along a direction from the first side edge to the third side edge. A region between the first sub-base plate 101 and the second sub-base plate 102 may be folded such that the back of the first sub-base plate 101 and the back of the second sub-base plate 102 may be attached. The second side plate 12 may be divided into two parts 12*a* and 12*b* along the folding line of the first sub-base plate 101 and the second sub-base plate 102. As used herein, the part 12*a* corresponding to the first sub-base plate 101 may be folded relative to the first sub-base plate 101 in a direction facing away from the back of the first sub-base plate 101 to be perpendicular to or substantially perpendicular to the first sub-base plate 101, and the part 12*b* corresponding to the second sub-base plate 102 may be folded relative to the second sub-base plate 102 in a direction facing away from the back of the second sub-base plate 102 to be perpendicular to or substantially perpendicular to the second sub-base plate 102. The fourth side plate 14 may be divided into two parts 14*a* and 14*b* along the folding line of the first sub-base plate 101 and the second sub-base plate 102. As used herein, the part 14*a* corresponding to the first sub-base plate 101 may be folded relative to the first sub-base plate 101 in the direction facing away from the back of the first sub-base plate 101 to be perpendicular to or substantially perpendicular to the first sub-base plate 101, and the part 14*b* corresponding to the second sub-base plate 102 may be folded relative to the second sub-base plate 102 in the direction facing away from the back of the second sub-base plate 102 to be perpendicular to or substantially perpendicular to the second sub-base plate 102.

It should be noted that, in some embodiments of the present disclosure, the first sub-base plate 101 may be the same as the first sub-base plate, and the second sub-base plate 102 may be the same as the second sub-base plate, which refers to a component that supports the packaged object and forms the packaging space with the film 20.

In some embodiments, the double-layer protective liner of the film package is unfolded as shown in FIG. 7. Referring to FIG. 8*a* to FIG. 8*d*, the folding process may include the following operations. First, the first side plate 11 may be folded relative to the first sub-base plate 101 towards the side facing away from the film 20. The third side plate 13 may be folded relative to the second sub-base plate 102 towards the side facing away from the film 20 (as shown in FIG. 8*b*). Then, the part 12*a* of the second side plate relative to the first sub-base plate 101 and the part 12*b* of the second side plate relative to the second sub-base plate 102 may be folded along a direction facing away from the back of the two sub-inner base plates 10 so that the part 12*a* of the second side plate 12 is perpendicular to or substantially perpendicular to the first sub-base plate 101 and the part 12*b* of the second side plate 12 is perpendicular to or substantially perpendicular to the second sub-base plate 102. The part 14*a* of the fourth side plate relative to the first sub-base plate 101 and the part 14*b* of the fourth side plate relative to the second sub-base plate 102 may be folded along the direction facing away from the back of the two sub-inner base plates 10 so that the part 14*a* of the fourth side plate 14 is perpendicular to or substantially perpendicular to the first sub-base plate 101 and the part 14*b* of the fourth side plate 12 is perpendicular to or substantially perpendicular to the second sub-base plate 102. Therefore, the structure shown in FIG. 8*c* may be formed. At this time, the first sub-base plate 101 and the second sub-base plate 102 may be relatively folded so that the backs of the two sub-inner base plates may be adhered to form the structure shown in FIG. 8*d*. In the structure, the object may be placed between the surface of the first sub-base plate 101 and the film 20 and/or between the surface of the second sub-base plate 102 and the film 20 to form a double-face film protection structure on the top and bottom.

In some embodiments, the double-layer protective liner of the film packaging in FIG. 7 to FIG. 8*d* may replace the protective liner in FIG. 1 to FIG. 6*f*. That is, the packaging structure may include a double-layer liner sheet and the box body plate connected thereof.

Based on the same inventive idea, in some embodiments, a packaging box is also provided, which may include a box body and a protective liner of the film packaging provided in the above embodiments. The protective liner of the film packaging may be disposed in the box body and provide a good effect of fixation and protection for the object.

In some embodiments, an object packaging is generally packaged by a corrugated box with an internal buffer packaging structure. The inner buffer packaging structure with the film 20 may include the base plate 10 and the film 20 covering the base plate 10. The film 20 may be a single piece of film. When packaging, the film 20 may entirely cover a packaged object. However, the market price of the film 20 with stable performance may be relatively high, resulting in an overall high price. In some embodiments, the present disclosure also provides a packaging structure. By adjusting the structure of the film 20, the amount of the film 20 may be reduced, thereby reducing the cost of packaging.

In some embodiments, in order to further reduce the cost of fixing and packaging, the area of the film 20 may be adjusted according to actual conditions.

In some embodiments, the area of the film 20 may be smaller than the size of the packaged object 3, which may refer to that the area of the film 20 is smaller than the packaging area. It may be understood that the film 20 may not need to completely cover the packaged object, but achieve the packaging and fixation by only covering key parts of the packaged object, thereby effectively reducing the area of the film 20 required for packaging and fixing. In some embodiments, the film used with the sheet 1 may include a count of sub-films. A fixed part of each sub-film may be respectively connected with at least two side plates around the base plate 10. A packaging part of the sub-films may correspond to the key parts of the object to be packaged. When the object is in a packaging state, the packaging parts of the plurality of sub-films may compress the key parts of the object to fix the object.

In some embodiments, the key parts of the object (i.e., the packaged object) may at least include an angle part, an edge part, a central part, etc. of the object. The angle part may refer to a sharp angle of the object, for example, four angles of a cuboid. The edge part may refer to the edge of the object. For example, if the object is a cube, the edge part may be the regions near the edges of the six surfaces of the cube. The central part may refer to a region other than the angle part and the edge part, or a region around the central axis of the object, for example, a region passing through the central axis on each face of the cube. In some embodiments, the film 20 may compress one of the key parts to save the area of the required film 20, or a plurality of key parts may be independently fixed by the film 20 to effectively improve the reliability of transportation.

Referring to FIG. 9 to FIG. 16, in some embodiments, a packaging structure may include the sheet 1 and the plurality of films 20. The plurality of films 20 may be fixed on the sheet 1, and optionally, the plurality of films 20 may be annularly distributed on the sheet 1. The film 20 may include the fixed part 23 fixedly connected with the sheet 1 and the packaging part 22. The packaging part 22 may cooperate with the sheet 1 to form a packaging space for packaging specific parts (e.g., edges and/or angles) of the packaged object 3.

The packaging structure may wrap the edges and/or the angles of the packaged object 3 by the packaging part 22 without the need to wrap the whole packaged object 3. The whole area of all the films 20 may be much smaller than the packaged object 3. Therefore, the film 20 may be reduced and the cost may be reduced. Furthermore, since the film 20 is annularly distributed on the sheet 1, the packaged object 3 may be placed directly at the center of the sheet 1 during packaging, and the edges and/or the angles of the packaged object 3 may be inserted into the package space between the packaging part 22 and the sheet 1, which reduces the difficulty of packaging. In addition, the packaging part 22 may fix the edges and/or the angles of the packaged object 3, so that the packaged object 3 may be firmly fixed.

Figure 11A:
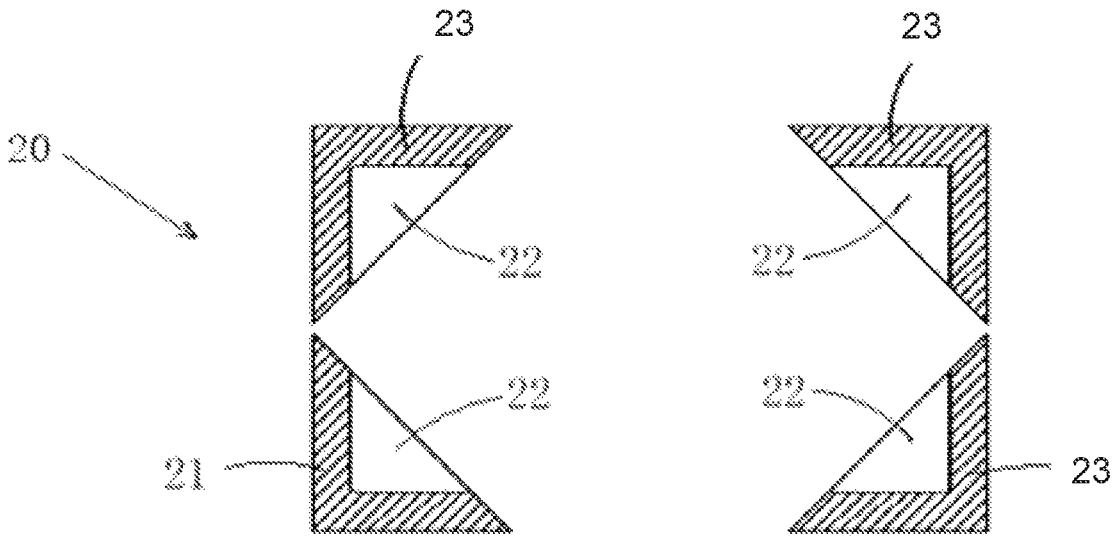
FIG. 11*a* and FIG. 11*b* are diagrams illustrating different parts of a packaging structure according to some embodiments of the present disclosure.
Figure 11B:
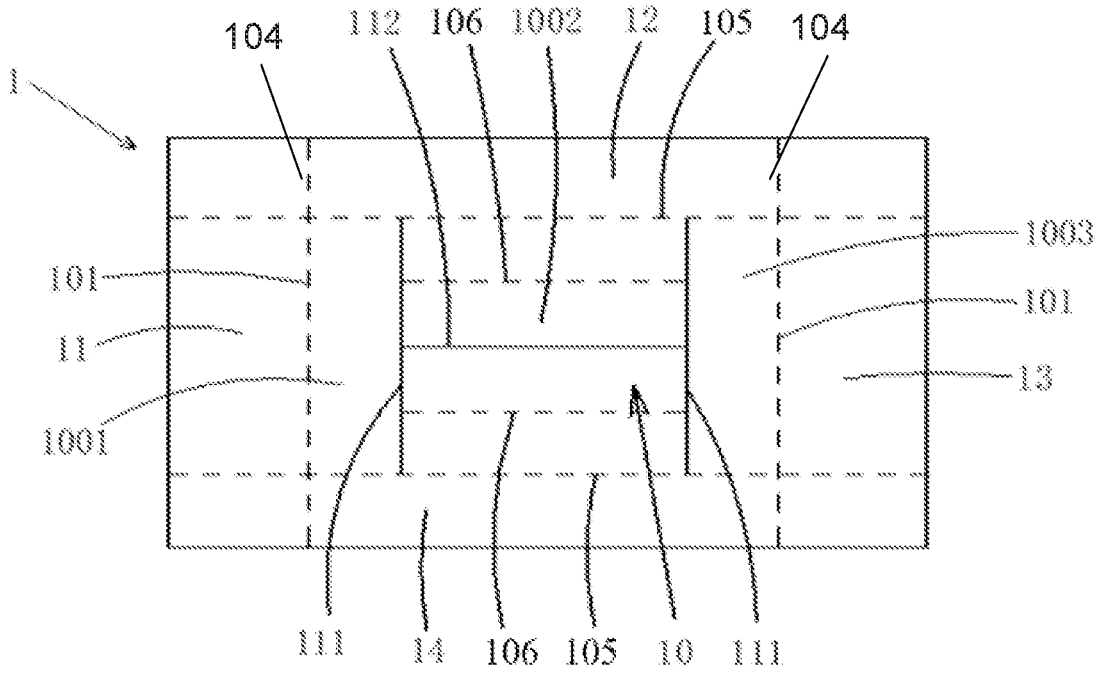

Further, referring to FIG. 11*a* and FIG. 11*b*, in some embodiments, the sheet 1 may be disposed with two first folding marks 104 disposed longitudinally and two second folding marks 105 disposed horizontally. The two first folding marks 104 and the two second folding marks 105 may be disposed crosswise, and divide the sheet 1 to form the base plate 10 at the center, the first side plate 11 and the third side plate 13 on opposite sides of the base plate 10, and the second side plate 12 and the fourth side plate 14 on the other opposite sides of the base plate 10. The film 20 may be disposed at the intersection of the first folding mark 104 and the second folding mark 105. The fixed part 23 of the film 20 may be disposed outside of the base plate 10. The packaging part 22 of the film 20 may be located above the base plate 10 and constructed that the sheet 1 may tighten the film 20 when the sheet 1 is folded along the first folding mark 104 and the second folding mark 105 towards the side facing away from the film 20. That the fixed part 23 of the film 20 is disposed outside of the base plate 10 may refer to that the fixed part 23 of the film 20 may be connected with a position on the sheet 1 other than the base plate 10. That is, the fixed part 23 may be connected with the first side plate 11, the second side plate 12, the third side plate 13, or the fourth side plate 14.

Referring to FIG. 9, FIG. 11*a* to FIG. 13, in some embodiments, the fixed part 23 of each sub-film may be fixedly connected with two adjacent side plates of the first side plate 11, the second side plate 12, the third side plate 13, and the fourth side plate 14. The packaging part 22 of each sub-film may correspond to the angle part of the base plate 10. As used herein, the angle part of the base plate 10 may refer to one of the four angles of the base plate 10. When the packaged object needs to be packaged and fixed, the object may be placed on the base plate 10 and the angle part of the object may be inserted into the packaging space formed by the angle part of the base plate 10 and the packaging part 22 of the sub-film. By doing so, the angle part of the object may be effectively fixed and protected by the packaging part 22 of the sub-film, improving the reliability of transportation.

In some embodiments, the film 20 may include 2 to 4 sub-films. The fixed part 23 of each sub-film may be located outside of the base plate 10. The outside of the base plate 10 may refer to components including the first side plate 11, the second side plate 12, the third side plate 13, and the fourth side plate 14. In some embodiments, the outside of the base plate 10 may further include corner plates of the sheet 1. In some embodiments, when the count of the sub-films is four, the fixed part 23 of each sub-film may be located around the four angles of the base plate 10. For example, as shown in FIG. 9, the fixed parts 23 of the sub-films may be respectively fixed to the first side plate 11 and the second side plate 12, the second side plate 12 and the third side plate 13, the third side plate 13 and the fourth side plate 14, the fourth side plate 14 and the first side plate 11. When the count of the sub-films is three, the fixed part 23 of each sub-film may be located around any three angles of the base plate 10. When the count of the sub-films is two, the fixed part 23 of each sub-film may be located around two opposite angles of the base plate 10. For example, the fixed parts 23 of the two sub-films may be respectively fixed on the first side plate 11 and the second side plate 12, and the third side plate 13 and the second side plate 12. In some alternative embodiments, the count of the sub-films may be one. For example, based on the embodiment shown in FIG. 9, the packaging parts 22 of two adjacent sub-films among the four sub-films may be connected with each other, and the fixed parts 23 of the two adjacent sub-films may be connected with each other to form a single sub-film. A hole may be formed under the middle part of the single sub-film. The packaged object may be inserted into the packaging space from the hole.

Figure 10:
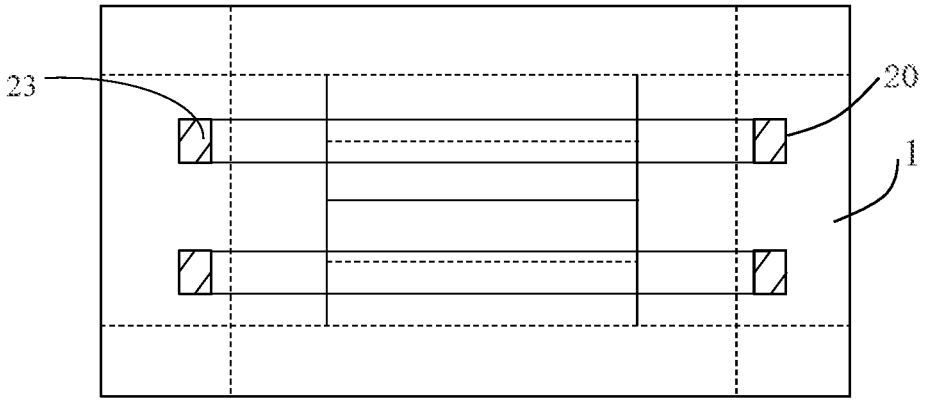
FIG. 10 is a schematic diagram of a packaging structure according to other embodiments of the present disclosure.

As shown in FIG. 10, in some other embodiments, the fixed part 23 of the sub-film may also be fixedly connected with two opposite side plates of the first side plate 11, the second side plate 12, the third side plate 13, and the fourth side plate. The packaging part 22 of each sub-film may correspond to an edge part of or intersect the base plate 10. The edge part of the base plate 10 may refer to the side along the horizontal or longitudinal direction of the base plate 10. In the embodiment, the packaging part 22 of the sub-film may not protect the angle part of the packaged object. The packaging approach may be suitable for objects with characteristics that no angle part is present or the angle part is not easy to be worn.

In some embodiments, the film 20 may include one to three sub-films. The fixed part 23 of each sub-film may be located outside of the base plate 10. In some embodiments, when the count of the sub-films is one, the packaging part 22 of the sub-film may be disposed to fix the central part of the packaged object. For example, when the packaged object is a disk, the packaging part 22 of the sub-film may be disposed to pass through the center axis of the disk to achieve the fixation of the center of the disk. When the count of the sub-films is two, the packaging parts 22 of the two sub-films may be disposed to fix both sides (as shown in FIG. 10) of the central part of the packaged object. When the count of the sub-films is three, one of the packaging parts 22 of the sub-films may be disposed to fix the central part of the packaged object, and the other packaging parts 22 may be disposed to fix the both sides of the central part of the packaged object. In other alternative embodiments, the count of the sub-films may be greater than 3, and the count may be determined according to the actual situation of the packaged object.

When packaging the object, the packaged object 3 may be placed on the base plate 10. The angle of the packaged object 3 may be placed in a space formed by the base plate 10, the packaging part 22, and the fixed part 23 of the film 20. The sheet 1 may be reversely folded along the first fixing mark 104 and the second fixing mark 105 to ensure that the packaging part 22 of the film 20 fasten the packaged object 3. As shown in FIG. 6, "The sheet 1 may be reversely folded" may refer to that the sheet 1 may be folded towards the side facing away from the packaged object 3 (i.e., the side facing away from the film 20). Although the packaging process may be simple, the film 20 may firmly fix the packaged object 3.

The film 20 in one or more embodiments of the present disclosure may restrict the object in the stretching direction. In some embodiments, the packaging structure may further include a limiting part. On one hand, the limiting part may be used to limit a movement of the object in the non-stretching direction; on the other hand, when the height of the limiting part is higher than the thickness of the object and another object is placed onto the limiting part, the limiting part may avoid the another object from directly contacting the upper surface of the packaged object 3, thereby strengthening the protection of the packaged object 3 and improving the reliability of transportation.

In some embodiments, as shown in FIG. 9 to FIG. 13, the base plate 10 may be disposed with two first cutting lines 111 disposed longitudinally. Both ends of a first cutting line 111 may be connected with two second folding marks 105. The first cutting lines 111 may divide the base plate 10 into a first base plate 1001, a second base plate 1002, and a third base plate 1003 that are disposed in sequence. A second cutting line 112 connecting with the two first cutting lines 111 may be disposed on the second base plate 1002. The second cutting line 112 may divide the second base plate 1002 into two limiting plates 16. The two limiting plates 16 may be folded along the second folding mark 105, so that the limiting plate 16 may block the side of the packaged object 3 near the second folding mark 105. Therefore, the packaged object 3 may be limited, and the packaging protection of packing object 3 may be strengthened.

It should be noted that the second folding mark 105 in the embodiment may be the same as the first folding line and the second folding line in the previous embodiment. The limiting plate 16 may be folded and/or overturned by using the folding mark or the folding line as an axis.

In some embodiments, at least one of the two limiting plates 16 may be disposed with a third folding mark 106 disposed horizontally. The limiting plate 16 may be folded along the third folding mark 106 to form a double-layer structure, thereby strengthening the limiting of the side of the packaged object 3.

In some embodiments, the height of the limiting plate 16 may be greater than the maximum deformation height of the film 20 or the packaging thickness of the object. As used herein, the "maximum deformation height of the film 20" may refer to the height that the film 20 is allowed to deform when packaging the object 3. The packaging thickness of the object may be understood as the height perpendicular to the surface of the base plate when the object is in the packaging state. If the height of the limiting plate 16 is greater than the maximum deformation height of the film 20 or the package thickness of the object, that is, higher than the packaged object 3, the limiting plate 16 may protect the top of the packaged object 3. When another object is placed on the top of the object 3, another object may be prevented from directly contacting the upper surface of the packaged object 3. The protection of the packaged object 3 may be strengthened. In some alternative embodiments, the height of the limiting plate 16 may be less than the maximum deformation height of the film 20 or the packaging thickness of the object, as long as the object may be restricted from moving in the stretching direction of the film 20.

Figure 12:
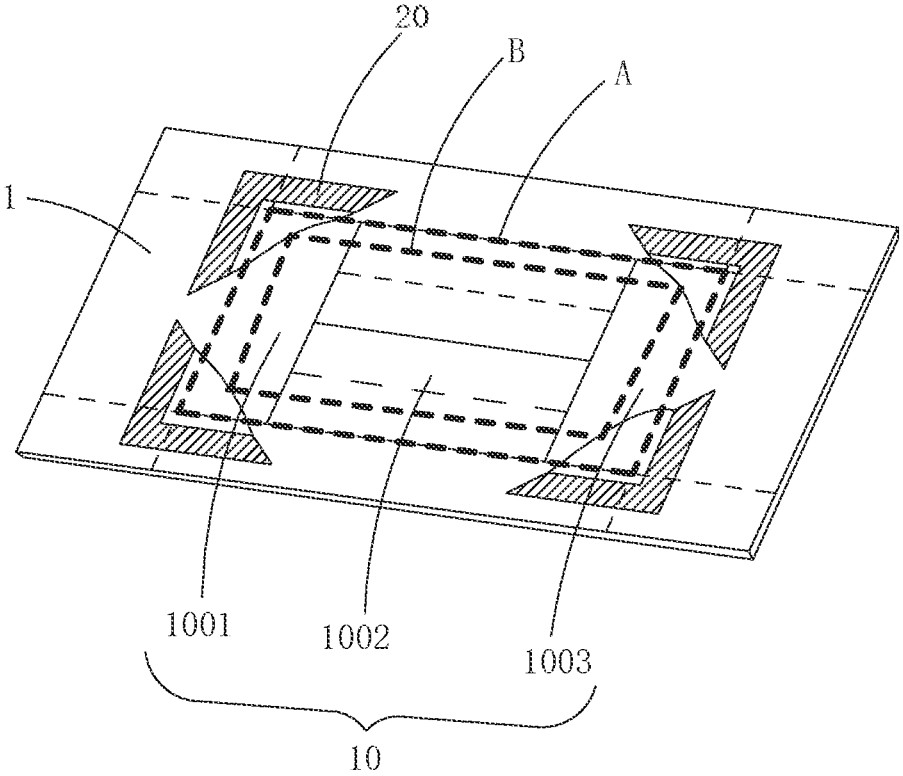
FIG. 12 is a perspective diagram illustrating a packaging structure according to some embodiments of the present disclosure.

Referring to FIG. 12, in some embodiments, the size of the packaged object 3 may be matched according to the deformation of the film 20. However, the packaged object 3 may not be larger than the size of the box A (the size of the box A is the same as the size of the base plate 10) and may not be smaller than the size of box B. In some embodiments, the size of the packaged object may need to be smaller than a first size (i.e., the box A). If the size of the packaged object exceeds the first size, the packaging space formed by the angle parts of the base plate 10 and the packaging parts 22 of the sub-films may not accommodate the angle part of the packaged object. Therefore, the packaged object cannot be packaged and fixed. In some embodiments, the size of the packaged object may need to be larger than a second size (i.e., the box B). If the size of the packaged object is smaller than the second size, it may refer to that the angle part of the packaged object may not be inserted into the packaging space formed by the angle parts of the base plate 10 and the packaging parts 22 of the sub-films. The sub-films may not effectively compress the packaged object to fix the packaged object.

In some embodiments, the structure of the film 20 may be determined according to the characteristics of the packaged object. In one embodiment, as shown in FIG. 11*a*, and FIG. 12, the sub-films of the film 20 may be triangular. Two sides of the triangular film 20 may be adhered to the sheet 1, respectively. The part that the film 20 is adhered to the sheet 1 may be the fixed part 23 of the film 20, and the other part of the film 20 may be the packaging part 22 of the film 20. The packaging part 22 may not only fix the packaged object 3 but also cover the angle part of the packaged object 3 to form a better protective effect. When the packaged object has the angle part that needs to be protected, a triangular film 20 (or sub-films thereof) may be used for packaging and fixing. When the sub-film is a triangular shape, the corner plate 15 (As shown in FIG. 2) may be also disposed between the two adjacent side plates (e.g., the first side plate 11 and the second side plate 12, the third side plate 13 and the fourth side plate 14, etc.). The fixed part 23 of the film 20 may be fixed to the two adjacent side plates and the corner plate 15 between the two side plates.

Figure 16:
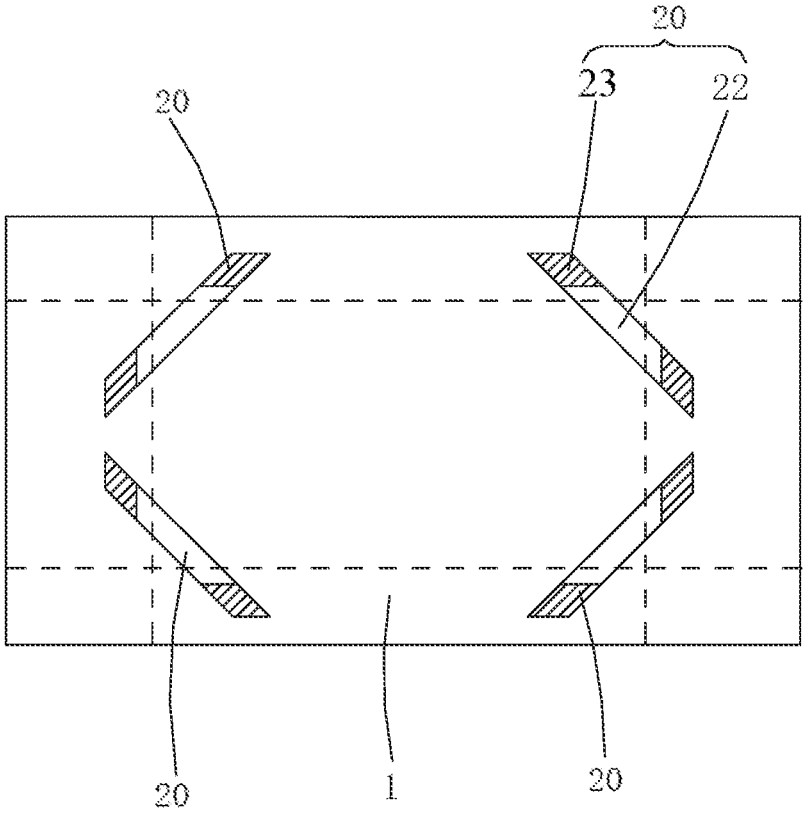
FIG. 16 is a front diagram illustrating a packaging structure according to some embodiments of the present disclosure.

In one embodiment, as shown in FIG. 16, the film 20 may include a trapezoidal shaped sub-film. Both ends of a sub-film may be respectively adhered to the sheet 1. The structure of the film 20 of the embodiment may be simpler and uses less material, which may greatly reduce the cost. When the packaged object is not easily damaged, the film 20 with a smaller area may be used for packaging and fixing, thereby further reducing the cost.

In other embodiments, as shown in FIG. 1, the shape of the film 20 may also have a strip shape. The shape of the film 20 may not be limited in the present disclosure. The shape of the film 20 may be selected according to the actual situation, as long as the fixed part (e.g., the first fixed part, the second fixed part, etc.) of the film may be fixed to a position other than the base plate of the sheet 1 (e.g., fixed on the side plate(s)).

Further, the film 20 may be a plastic film 20. The packaging effect may be good and the cost may be low.

Further, the sheet 1 may be cardboard which is recyclable and environment friendly.

It should be noted that the packaging component, the protective liner of the film packaging, the packaging box, and the packaging structure in the present disclosure may be combined with each other. For example, the protective liner of the film packaging in FIG. 5 and FIG. 6 may be replaced with the packaging structure shown in FIG. 9 to FIG. 16, and a packaging person may use a suitable liner as needed.

One or more embodiments in the present disclosure may include but not be limited to the following beneficial effects. (1) By fixing the film on the foldable side plate(s), the side plate(s) may stretch the film when folded. The film in the tension state may compress the packaged object, thereby increasing the resistance between the film and the packaged object and improving the reliability of transportation. (2) By disposing the plurality of cutting lines on the film, the cutting line may form the stretched hole when the film is stretched, thereby further increasing the resistance between the film and the packaged object and improving the reliability of transportation. (3) By disposing the first supporting plate and the second supporting plate, the packaging structure may be supported. (4) By disposing the handle hole, the packaging structure may be easy to be lifted.

Having thus described the basic concepts, it may be rather apparent to those skilled in the art after reading this detailed disclosure that the foregoing detailed disclosure is intended to be presented by way of example only and is not limiting. Various alterations, improvements, and modifications may occur and are intended to those skilled in the art, though not expressly stated herein. These alterations, improvements, and modifications are intended to be suggested by this disclosure and are within the spirit and scope of the exemplary embodiments of this disclosure.

Moreover, certain terminology has been used to describe embodiments of the present disclosure. For example, the terms "one embodiment," "an embodiment," and/or "some embodiments" mean that a particular feature, structure, or characteristic described in connection with the embodiment is included in at least one embodiment of the present disclosure. Therefore, it is emphasized and should be appreciated that two or more references to "an embodiment" or "one embodiment" or "an alternative embodiment" in various portions of the present disclosure are not necessarily all referring to the same embodiment. Furthermore, the particular features, structures, or characteristics may be combined as suitable in one or more embodiments of the present disclosure.

Similarly, it should be appreciated that in the foregoing description of embodiments of the present disclosure, various features are sometimes grouped together in a single embodiment, figure, or description thereof to streamline the disclosure aiding in the understanding of one or more of the various inventive embodiments. This method of disclosure, however, is not to be interpreted as reflecting an intention that the claimed object matter requires more features than are expressly recited in each claim. Rather, inventive embodiments lie in less than all features of a single foregoing disclosed embodiment.

In some embodiments, the numbers expressing quantities, properties, and so forth, used to describe and claim certain embodiments of the application are to be understood as being modified in some instances by the term "about," "approximate," or "substantially." For example, "about," "approximate" or "substantially" may indicate ±20% variation of the value it describes, unless otherwise stated. Accordingly, in some embodiments, the numerical parameters set forth in the written description and attached claims are approximations that may vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the application are approximations, the numerical values set forth in the specific examples are reported as precisely as practicable.

Each of the patents, patent applications, publications of patent applications, and other material, such as articles, books, specifications, publications, documents, things, and/or the like, referenced herein is hereby incorporated herein by this reference in its entirety for all purposes, excepting any prosecution file history associated with same, any of same that is inconsistent with or in conflict with the present document, or any of same that may have a limiting effect as to the broadest scope of the claims now or later associated with the present document. By way of example, should there be any inconsistency or conflict between the description, definition, and/or the use of a term associated with any of the incorporated material and that associated with the present document, the description, definition, and/or the use of the term in the present document shall prevail.

In closing, it is to be understood that the embodiments of the application disclosed herein are illustrative of the principles of the embodiments of the application. Other modifications that may be employed may be within the scope of the application. Thus, by way of example, but not of limitation, alternative configurations of the embodiments of the application may be utilized in accordance with the teachings herein. Accordingly, embodiments of the present application are not limited to that precisely as shown and described.

What is claimed is:

1. A packaging structure, comprising:

a sheet including a base plate and a first side plate, a second side plate, a third side plate, and a fourth side plate, the first side plate, the second side plate, the third side plate, and the fourth side plate being distributed around the base plate; and a film at least including a first fixed part and a second fixed part, the first fixed part and the second fixed part being fixedly connected with at least two side plates of the first side plate, the second side plate, the third side plate, and the fourth side plate, respectively, wherein, the first side plate is disposed opposite to the third side plate, and the second side plate is disposed opposite to the fourth side plate, the first fixed part and the second fixed part of the film are fixedly connected with the first side plate and the third side plate respectively, wherein a plurality of cutting lines are disposed on the film to form a plurality of stretching holes;

the film includes only one display region in a central region of the film and two non-display regions, the two non-display regions are located at two opposite sides of the central region, respectively, along a longitudinal direction of the film from the first side plate to the third side plate, the plurality of cutting lines are only distributed at the two non-display regions such that the display region is a smooth region for displaying a packaged object.

2. The packaging structure of claim 1, wherein the plurality of cutting lines include an arc line or a straight line.

3. The packaging structure of claim 1, wherein the plurality of cutting lines are evenly distributed in a region of the film.

4. The packaging structure of claim 1, wherein:

the base plate includes a first sub-base plate and a second sub-base plate, and a folding line disposed between the first sub-base plate and the second sub-base plate;

the second side plate includes two second sub-side plates disposed on either side of the folding line; and the fourth side plate including two fourth sub-side plates disposed on either side of the folding line.

5. The packaging structure of claim 1, further comprising:

a box body plate, the box body plate including a box base plate, a first folding plate, a second folding plate, a third folding plate, and a fourth folding plate, the first folding plate, the second folding plate, the third folding plate, and the fourth folding plate being distributed around the box base plate, wherein, the first folding plate is disposed opposite to the third folding plate, and the second folding plate is disposed opposite to the fourth folding plate; and the fourth folding plate is connected with the sheet at a side facing away from the box base plate.

6. The packaging structure of claim 5, wherein the second folding plate is connected with a cover plate at a side facing away from the box base plate, and the cover plate is disposed opposite to the box base plate in a folding state of the packaging structure.

7. The packaging structure of claim 1, wherein the film is configured to fasten an object at a packaging area of the packaging structure, and an area of the film is smaller than that of the packaging area.

8. The packaging structure of claim 7, wherein the film has a plurality of sub-films, each of which includes a fixed part and a packaging part, the fixed part of each sub-film connected with at least part of the at least two side plates, the packaging part of each sub-film covering at least part of the object to fasten the object in the packaging structure.

9. The packaging structure of claim 8, wherein the fixed part of each sub-film is fixedly connected with two adjacent side plates of the first side plate, the second side plate, the third side plate, and the fourth side plate respectively, the packaging part of each sub-film corresponding to an angle part of the base plate.

10. The packaging structure of claim 9, wherein a count of the sub-films is between the range of 2 to 4, the fixed part of each sub-film being disposed outside of the base plate.

11. The packaging structure of claim 8, wherein the fixed part of each sub-film is fixedly connected with two opposite side plates of the first side plate, the second side plate, the third side plate, and the fourth side plate, respectively.

12. The packaging structure of claim 1, wherein the first supporting plate is connected with a margin of the base plate by a first folding line, the second supporting plate is connected with a margin of the base plate by a second folding line, wherein the first folding line is disposed opposite to the second folding line.

13. The packaging structure of claim 12, wherein two first cutting lines and a second cutting line are disposed on the base plate, both ends of each first cutting lines being connected with the first folding line and the second folding line, the second cutting line being connected with the two first cutting lines.

14. The packaging structure of claim 1, wherein the film is configured to fasten an object when being stretched by folding the first side plate and the third side plate towards a back of the base plate.

15. The packaging structure of claim 2, wherein the plurality of cutting lines include a semi-arc shape, an angular shape, or two semi-arcs connected via a straight line.

16. The packaging structure of claim 6, wherein the fourth folding plate is connected with the fourth side plate at the side facing away from the base plate.

17. The packaging structure of claim 11, wherein the at least part of the object includes at least one of an angle part, an edge part, and a central part of the object.

18. The packaging structure of claim 1, wherein each of the plurality of cutting lines includes two semi-arcs connected via a straight line.

19. The packaging structure of claim 18, wherein the two semi-arcs are two symmetrically disposed semi-circular cuts whose bending directions are opposite.

20. The packaging structure of claim 1, wherein the plurality of cutting lines have different shapes.

* * * * *